US007614874B2

(12) United States Patent
Mochizuki et al.

(10) Patent No.: US 7,614,874 B2
(45) Date of Patent: Nov. 10, 2009

(54) FOLDABLE IGNITOR

(76) Inventors: Tetsuya Mochizuki, c/o Fuji Oyama Factory, Tokai Corp., 3-4 Shimohara, Subashiri, Oyama-cho Sunto-gun, Shizuoka (JP) 410-1431; Takayuki Suzuki, c/o Fuji Oyama Factory, Tokai Corp., 3-4 Shimohara, Subashiri, Oyama-cho Sunto-Gun, Shizuoka (JP) 410-1431; Makoto Sato, c/o Fuji Oyama Factory, Tokai Corp., 3-4 Shimohara, Subashiri, Oyama-cho Sunto-Gun, Shizuoka (JP) 410-1431

( * ) Notice: Subject to any disclaimer, the term of this patent is extended or adjusted under 35 U.S.C. 154(b) by 1 day.

(21) Appl. No.: 12/065,128

(22) PCT Filed: Aug. 31, 2006

(86) PCT No.: PCT/IB2006/004151

§ 371 (c)(1),
(2), (4) Date: Mar. 18, 2008

(87) PCT Pub. No.: WO2007/110701

PCT Pub. Date: Oct. 4, 2007

(65) Prior Publication Data

US 2008/0220386 A1 Sep. 11, 2008

(51) Int. Cl.

| | |
|---|---|
| ***F23Q 3/01*** | (2006.01) |
| *F23D 11/36* | (2006.01) |
| *F23Q 2/28* | (2006.01) |
| *F23Q 3/00* | (2006.01) |
| *F23Q 7/12* | (2006.01) |
| *H01I 41/08* | (2006.01) |

(52) U.S. Cl. ..... 431/153; 431/255; 431/258; 431/344; 431/345; 431/358; 30/38; 30/47; 30/155

(58) Field of Classification Search ..... 431/153, 431/255, 258, 344, 345, 358; 30/38, 47, 30/155; *F23D 11/36; F23Q 2/28, 3/00, F23Q 3/01, 7/12; H01I 41/08*
See application file for complete search history.

(56) References Cited

U.S. PATENT DOCUMENTS 5,597,299 A * 1/1997 Jon ..... 431/153

(Continued)

FOREIGN PATENT DOCUMENTS

| | | | |
|---|---|---|---|
| JP | S47-7511 | * | 4/1972 |
| JP | H05-14172 | * | 10/1984 |
| JP | H09-133359 | * | 11/1995 |
| JP | 2007113912 A | * | 5/2007 |

*Primary Examiner*—Steven B McAllister
*Assistant Examiner*—Daniel E Namay
(74) *Attorney, Agent, or Firm*—Trojan Law Offices

(57) ABSTRACT

A foldable lighter that prevents inadvertent ignition by erroneously pressing on the operating button at time of folding the swing-arm to make the lighter compact. A foldable lighter 1 that comprises a lighter lighter body 2 that contains a fuel tank, a piezoelectric unit 102 and an operating button 8, and swing-arm 4 connected with free swinging to one end of lighter body 2 and that incorporates a locking mechanism that prevents accidental depression of the operating button 8. The locking mechanism consists of a projecting portions 74 formed in a predetermined range of the cylindrical walls 26*a*, 26*c* made integrally with a swing-arm 4 and a hook 8*b* that extends from the operating button along a portion of the cylindrical walls. The aforementioned predetermined range prescribed for the projecting portions is the range in which the hook 8*b* interferes with the projecting portions when the swing-arm 4 is turned relative to the lighter body 2 by an angle which is below a predetermined value so that if the operating button 8 is depressed when the swing-arm 4 is turned relative to the lighter body 2 by an angle which is below a predetermined value, the hook 8*b* will interfere with the projecting portion 74 and the depression of the button will be prevented.

4 Claims, 18 Drawing Sheets

U.S. PATENT DOCUMENTS

| | | | | |
|---|---|---|---|---|
| 5,697,775 | A * | 12/1997 | Saito et al. | 431/153 |
| 6,488,492 | B2 * | 12/2002 | Adams et al. | 431/153 |
| 6,666,679 | B1 * | 12/2003 | Ye | 431/153 |
| 7,070,408 | B2 * | 7/2006 | Sgroi et al. | 431/153 |
| 7,500,850 | B1 * | 3/2009 | Fontaine | 431/253 |
| 2002/0055076 | A1 * | 5/2002 | Adams et al. | 431/153 |
| 2002/0055077 | A1 * | 5/2002 | Adams et al. | 431/255 |
| 2002/0106601 | A1 * | 8/2002 | Adams et al. | 431/255 |
| 2003/0157449 | A1 * | 8/2003 | Suzuki et al. | 431/153 |
| 2005/0053881 | A1 * | 3/2005 | Sgroi et al. | 431/153 |
| 2005/0053883 | A1 * | 3/2005 | Faber | 431/253 |
| 2007/0160941 | A1 * | 7/2007 | Lin | 431/142 |
| 2007/0160945 | A1 * | 7/2007 | Lin | 431/344 |

* cited by examiner

FOLDABLE IGNITOR

PRIORITY CLAIM

The present application is a U.S. National Stage Application under 35 U.S.C. 371 of PCT/IB2006/004151, filed on Aug. 31, 2006, which claims priority to Japanese Patent Application 2005-254866, filed on Sep. 2, 2005.

TECHNICAL FIELD

This invention relates to a lighter (igniter) that drives a piezoelectric unit by activating an operating component and that emits a flame from the tip of a swing-arm that extends from the lighter body. In particular, the invention relates to a foldable lighter which is provided with a swing-arm pivotally attached to the lighter body.

DESCRIPTION OF THE PRIOR ART

Formerly, lighters have been used for such devices as lighting gas burners and igniters for solid fuels and fireworks. As an example of such a lighter, is a well known lighter (Japanese Unexamined Patent Application Publication H9-133359 (FIG. 1)) that has a tip pipe (extension) extended in a rod-shape from the body for emitting a flame. In its body, the lighter has a gas tank and a piezoelectric unit operated by an operating component, and by operating the operating component a flame is emitted from the tip of the tip pipe. Due to the separation of the tip of the tip pipe emitting the flame from the body held by the hand, a lighter of this type can safely and easily ignite objects without burning the user, but there is a problem in that comparatively more space is required to store the lighter due to lengthening of the lighter overall dimensions.

The above problem is solved in well known lighters that can be made compact by extending and collapsing from the lighter body a rod-shaped extension for emitting a flame or can be folded when not in use. For example, known in the art is a pistol-shaped lighter (Japanese Examined Patent Application Publication S47-7511 (FIG. 2)) having a telescopically moveable barrel that is extended when it is necessary to ignite a flame and is withdrawn after use for making the lighter compact. A flame-blowing tube is located in the tip of the telescopic barrel. Another known device (Japanese Examined Patent H5-14172 (FIGS. 2 and 3)) is a foldable lighter that has a rod-like tip pivotally attached to one side of the lighter body. In this lighter, a tip portion (an elongated tube) is generally maintained in the folded position, and, when used (ignited), is turned into a position extending from the lighter body.

DESCRIPTION OF THE INVENTION

In the lighter disclosed in Patent Citation 2, the space that accommodates the lighter may be relatively small. After use of the lighter, the burner pipe is in a hot state, and there is a risk of burning when the exposed burner pipe is inserted into the barrel prior to cooling. Also, there is a danger of scorching clothing that contacts the hot burner pipe.

Similarly, regarding the lighter of Japanese Examined Patent H5-14172, the tip of the elongated tube is exposed, and the risk of burning a finger or scorching clothing still exists when the tube is brought into contact with a finger when turning the tube in the folded position or when the tube contacts clothing.

Based on the above information, it is an object of the present invention to provide a foldable lighter that occupies a small space for storage and prevents possibility of burning the user or damaging clothing when the lighter is converted into a compact state.

A foldable lighter comprising:

a lighter body that contains a fuel tank and a piezoelectric unit and has an operating component exposed to the outside for operating substantially simultaneously the aforementioned piezoelectric unit and a fuel supply valve that controls supply of fuel from the fuel tank;

a swing-arm that is pivotally connected at one end to the lighter body, has an opening at the other end, and can be pivotally turned relative to the lighter body between a folded position against the lighter body and an operational position in which the swing-arm is opened at 90 degrees or more than 90 degrees relative to the lighter body;

a flame emission nozzle in the vicinity of the other end of the swing-arm; and a flexible fuel supply tube located in the lighter body and the swing-arm and having one end that connects to the aforementioned fuel tank and the other end to the flame emission nozzle;

said foldable lighter being characterized by having a cylindrical wall that forms a substantially cylindrical annular space coaxial with the center of rotation [of said swing-arm], said cylindrical wall being formed in either the aforementioned lighter housing or in the swing-arm;

the swing-arm being provided with a pipe assembly that holds a part of a guide tube and the flame-emission nozzle inside the swing-arm and that is capable of sliding in the longitudinal direction of the swing-arm;

in the aforementioned folded position, the end of the pipe assembly on the side of the lighter body reaching the aforementioned annular space;

said annular space of the lighter body having: a stopper acting so that during rotation of the swing-arm from the folded position to the operational position, the stopper contacts the pipe assembly end on the lighter-body side and moves the pipe assembly forward under the effect of the aforementioned rotation whereby the end of the pipe assembly on the side of the flame-emission nozzle protrudes from the aforementioned opening; and an engagement member that engages the end of the pipe assembly on the lighter-body side during rotation of the swing-arm from the operational position to the folded position and withdraws the pipe assembly under the effect of the aforementioned rotation so that the end of the pipe assembly on the side of the flame-emission nozzle is withdrawn from the aforementioned opening into the swing-arm.

The lighter housing contains an axle portion, and the swing-arm has an outer cylindrical sleeve that is slidingly fitted onto the axle portion with the possibility of free rotation. The swing-arm also contains a cylindrical wall that is made integrally with the cylindrical sleeve and forms an annular space.

The end of the pipe assembly on the lighter-body side has a T-shaped configuration, and a transversely arranged portion of the T-shaped end may interact with an engagement member.

Located in the lighter body or in the swing-arm that is pivotally connected to the end of the lighter body is the foldable lighter of the invention, which has a cylindrical wall that forms an annular space coaxial with the axis of rotation of the swing-arm. The swing-arm slidingly holds a pipe assembly that retains a portion of a guide tube so that in the folded position of the swing-arm, the end of the pipe assembly on the side of the lighter body extends to the aforementioned annular space, and the annular space of the lighter body has a stopper acting so that during rotation of the swing-arm the fuel-nozzle end of the pipe assembly may protrude from the opening of the swing-arm under the effect of the aforementioned rotation and additionally has an engagement member acting so that the aforementioned nozzle-side end of the pipe assembly can be withdrawn into the swing-arm. Therefore, because of these conditions, the following effects are possible.

More specifically, when the foldable lighter is in use, the pipe assembly protrudes from the swing-arm into a position that allows ignition by merely turning the swing-arm into the open position, and even if the pipe assembly is in a hot state after use, the swing-arm can be turned into the folded position without any contact of the user with the hot pipe assembly. When the lighter is in the folded condition, the user is protected from burns and clothing is protected from scorching. Since the lighter is folded, it needs a small space for storage.

Since the swing-arm contains an axle portion, a cylindrical sleeve, which is slidingly fitted onto the outer periphery of the axle portion, and a cylindrical wall, which forms an annular space ands is made integrally with the aforementioned cylindrical sleeve, it becomes possible to provide smooth rotation of the swing-arm.

The T-shaped end of the pipe assembly on the lighter-body side and the transverse element on the T-shaped end that interacts with the engagement member make it possible to extend the pipe assembly from the swing-arm or withdraw the pipe assembly into the swing-arm in response to turning the swing-arm from one position to the other.

DESCRIPTION OF THE PREFERRED EMBODIMENTS

Preferred embodiment of the foldable lighter of the present invention (hereinafter referred to merely as a "lighter") will be further described in more detail with reference to the accompanying drawings. FIG. 1 is a perspective view showing a lighter 1 in the folded form. FIG. 2 is a perspective view showing lighter 1 in the open state ready for use. As shown in FIGS. 1 and 2, lighter 1 has a lighter body 2 for grasping by a user's hand and a swing-arm 4 axially supported to swing freely at one end of the lighter body 2. Within lighter body 2 are housed a later-described piezoelectric unit 102 (FIG. 8) and a fuel tank 106 (FIG. 8). A swing-mount 6 is formed at one end of lighter body 2, and a swing-mount unit 10 is formed on one end of swing-arm 4 and is mounted to swing-mount 6 for support by swing-mount 6. An operating button 8 (operating component) is installed in lighter body 2 to be exposed from an opening 32 in the vicinity of swing-mount 6. Pressing this operating button 8 with a finger causes ignition.

In a sidewall 14 of lighter body 2 (FIG. 2), an inspection window 12 is formed to enable checking of the remaining quantity of fuel such as liquefied gas. In addition, an opening 18 is formed in lighter body 2, from which protrudes an adjustor protrusion 16 for adjusting the length of the flame to be emitted. In addition, a pipe assembly 20 is housed in swing-arm 4 with the ability to slide in the lengthwise direction of swing-arm 4. When swing-arm 4 is in the closed position (housing position), specifically when it is folded for overlapping by lighter body 2, as shown in FIG. 1, pipe assembly 20 is pulled within swing-arm 4. Conversely, when swing-arm 4 is in the open position (position for use), specifically when swing-arm 4 is opened to an angle of 90 degrees or more in relation to lighter body 2, as shown in FIG. 2, a tip tube 20*a* of a pipe assembly 20 is projected from an exposure port 60*b* of a leading edge 4*a* of swing-arm 4.

Lighter body 2 has two reciprocally engaging components, specifically a half-lighter body 2*a* and a half-lighter body 2*b*, and a full-body cover 2*c* that maintains the reciprocally combined condition of half-bodies 2*a* and 2*b*. With reference to FIGS. 3 to 5, the following section describes half-bodies 2*a* and 2*b* and a full-body cover 2*c*. FIG. 3 is a perspective view showing half-lighter body 2*a*, which is the forward-facing half-body in FIGS. 1 and 2, with FIG. 3(*a*) displaying the half-lighter body 2*a* as seen from the outside and FIG. 3(*b*) displaying the half-lighter body 2*b* as seen from the inside. FIG. 4 shows half-lighter body 2*b*, which is the half-body opposite half-lighter body 2*a* of FIG. 3; FIG. 4(*a*) is a front view as seen from the inside, and FIG. 4(*b*) is a perspective view also as seen from the inside. FIG. 5 shows full-body cover 2*c*, FIG. 5(*a*) is a perspective view, and FIG. 5(*b*) is a perspective view displaying the cross-section along line 5*b*-5*b* of FIG. 5(*a*).

As shown in FIG. 3, half-lighter body 2*a* is integrally formed from a synthetic resin, for example, and consists of a cylindrically shaped axle portion 6*a* (pivot axle) structured as part of swing-mount 6 and a main portion 22*a*. At a cylindrically shaped surface 28*a* of an axle portion 6*a*, the half-body has a circular opening 24*a*, a cylindrically shaped axle socket 30*a* formed in succession with an opening 24*a*, and an annular wall (cylindrical wall) 26*a* formed at the outer side of an axle socket 30*a* and along the same axis as axle socket 30*a*. In a main portion 22*a*, a cutout 32*a* is formed to house the upper portion of an operating button 8. Main portion 22*a* has an upper wall 34*a* and a lower wall 36*a* extending approximately in parallel. At upper wall 34*a* and lower wall 36*a*, flange sections 38*a* and 39*a* are integrally formed to extend on opposite sides of axle portion 6*a*. The outer surface of main portion 22*a* is formed with channel 37*a* in the vertical direction for use in positioning full-body cover 2*c*. Furthermore, the vertical orientation shown here applies to the drawings referred to in the description.

This section describes in further detail axle portion 6*a* with reference to FIG. 3(*b*). Two ribs are formed at an outer surface 31*a* of axle socket 30*a*, specifically stoppers 40*a* and 41*a* at a prescribed interval. The stoppers 40*a* and 41*a* have respective notches 42*a* and 43*a* formed between each notch and the outer periphery 31*a* of the axle socket 30*a*. In addition, at the side of an annular wall 26*a* toward main portion 22*a*, a cutout 44*a* is formed axially inward. Moreover, at the inner surface of a main portion 22*a*, a protrusion 46*a* is formed to protrude inward in the vicinity of a cutout 44*a*, and in a separated position at the opposite end of main portion 22*a* from protrusion 46*a* is a socket seat 50*a* having an inward-facing elliptical recess 48*a*. A socket seat 50*a* is the shaft receptacle for operating button 8.

This section describes the opposing half-lighter body 2*b* with reference to FIG. 4. Half-lighter body 2*b* is a shape approximately reflective of half-lighter body 2*a*, and is provided with an axle 6*b* and a lighter body 22*b*. Axle 6*b* has an annular wall (cylindrical wall) 26*b* of the same outer diameter as axle portion 6*a*. Stoppers 40*b* and 41*b* are on an outer peripheral surface 31*b* of an axle socket 30*b* and correspond to stoppers 40*a* and 41*a*. Stoppers 40*a* and 40*b* together are referred to as engagement member 40, and stoppers 41 and 41*b* together are referred to as stopper 41. In contrast to axle socket 30*a*, within the periphery of axle socket 30*b* are three circumferentially notches 30*c*, 30*d*, and 30*e*. Main lighter body 22*b* is provided with cutout 32*b*, which corresponds to cutout 32*a*. Moreover, cutouts 32*a* and 32*b* enable structuring of a single opening 32 for receiving operating button 8 when half-bodies 2*a* and 2*b* are assembled (FIGS. 1 and 2).

Below cutout 32*b*, protrusion 46*b* and socket seat 50*b* are respectively identical to and correspond with previously described protrusion 46*a* and socket seat 50*a*. In upper wall 34*b* and lower wall 36*b* of main portion 22*b* are flange sections 38*b* and 39*b* in positions corresponding to previously described flange sections 38*a* and 39*a*. Socket seat 50*a* and socket seat 50*b* together form axle socket 50. Similarly, flange sections 38*a* and 38*b* together form support section 38, and 39*a* and 39*b* together form support section 39. Moreover, channel 37*b* is formed in main portion 22*b* of half-lighter body 2*b* and corresponds to channel 37*a*.

This section describes full-body cover 2*c* with reference to FIG. 5. Full-body cover 2*c* is used by first engaging the inner surfaces of previously described half-bodies 2*a* and 2*b* and then fitting full-body cover 2*c* over half-bodies 2*a* and 2*b* from the opposite end of the combined half-bodies 2*a* and 2*b*. Full-body cover 2*c* has an opening 54 formed by the pair of edges 52 and 52, which are curved upward at one end. As shown in FIG. 5(*b*), within full-body cover 2*c* are ribs 56*a*, 56*b*, and 56*c* that protrude into the interior of the full-body cover 2*c* for positioning previously described piezoelectric unit 102 and fuel tank 106 at the time of housing (FIG. 8). Rib 56*a* is formed as a pair of ribs at left and right in the lengthwise direction of full-body cover 2*c*; similarly, rib 56*b* is formed as a pair of ribs at top and bottom in the lengthwise direction (FIG. 8). Respective opposite side ribs 56*a*, 56*b*, and 56*c* are not shown in FIG. 5(*b*). Rib 56*c* is formed vertically at the farthest inner section. In addition, at each inner surface of sidewalls 14, a bead 58 is formed for engaging respectively to channels 37*a* and 37*b* of half-bodies 2*a* and 2*b* at the time of receiving previously described half-bodies 2*a* and 2*b*. Only one side of bead 58 is shown in FIG. 5. By engaging bead 58 to channels 37*a* and 37*b*, full-body cover 2*c* is positioned and also fixed.

This section describes in detail swing-arm 4, which, as explained above, is pivotally connected to lighter body 2 composed of half-bodies 2*a* and 2*b* and full-body cover 2*c*. FIG. 6 shows swing-arm 4, FIG. 6(*a*) is a perspective view, and FIG. 6(*b*) is a front view. Swing-arm 4 has a swing-mount unit 10 and a long protective cover 60 integrally formed to swing-mount unit 10. Protective cover 60 has a cavity 62 passing through the lengthwise direction within protective cover 60. Protective cover 60, which is made from a material with adiabatic properties such as a synthetic resin, is maintained to allow swinging of swing-arm 4 without touching tip tube 20*a* of pipe assembly 20. Swing-mount unit 10 is mounted for swinging by interposition support with free swinging between axles 6*a* and 6*b* of half-bodies 2*a* and 2*b*. Swing-mount unit 10 has an annular wall (cylindrical wall) 26*c* of approximately the same outer diameter as axles 6*a* and 6*b*. At annular wall 26*c*, an annular step 64 is formed for crowning of annular walls 26*a* and 26*b* of lighter body 2. Furthermore, at annular wall 26*c* and annular step 64, an opening 66 is formed for passage between the interior of annular wall 26*c* and cavity 62 of protective cover 60.

Within annular wall 26*c*, an arching inner wall (outer cylinder) 70 is integrally supported on the same axis as annular wall 26*c* by three support walls 68*a*, 68*b*, and 68*c* mutually spaced in the circumferential direction. A cylindrical space is formed between arching inner wall 70 and annular wall 26*c*. Support walls 68*a* and 68*c* are positioned symmetrically to bind the center arching inner wall 70, and support wall 68*b* is positioned at the lower end of arching inner wall 70 between support walls 68*a* and 68*b*. Furthermore, previously described axle sockets 30*a* and 30*b* are referred to as the inner cylinder in relation to the outer cylinder. The upper portion of arching inner wall 70 has a cutout that forms an opening 66.

At arching inner wall 70, two protrusion sections 72*a* and 72*b* are formed to protrude and to face half-lighter body 2*b*. Protrusion section 72*a* is formed in the lower section of support wall 68*a*, and protrusion section 72*b* is formed in a position approximately identical to that of support wall 68*c*. Bump-like protrusions 73 are formed on the leading edges of protrusion sections 72*a* and 72*b* facing inward. During assembly of swing-arm 4 and lighter body 2, these bump-like protrusions 73 of aforementioned protrusions sections 72*a* and 72*b* engage at three predetermined angles with notches 30*c*, 30*d*, and 30*e* of axle socket 30*b* of half-lighter body 2*b*. Specifically, during swing-arm 4 operation, clicking occurs when the swing-arm 4 is in the folded position, in the opened position for use, and at the midpoint position. In this way, it becomes possible to provide safe use of lighter 1 in any position by preventing the shifting of swing-arm 4 from predetermined angular positions.

As shown in FIG. 6, at the lower side of annular wall 26*c*, specifically at support wall 68*b*, a protrusion (thick section) 74 is formed that extends in the circumferential direction. Protrusion 74 is formed along the edge at the lighter body 2*b* side of annular wall 26*c* and extends from the lower end of annular wall 26*c* in both directions toward support wall 68*a* and support wall 68*c*. Protrusion 74 extends slightly toward support wall 68*a* and extends more than half the distance along the circumference of support walls 68*b* and 68*c*. In addition, arching inner wall 70 is established with rib 76 protruding at a position approximately identical to that of support wall 68. Furthermore, arching inner wall 70 is formed with a slot 78 directly below rib 76.

Protective cover 60 has a metal cap 60*a* with an exposure port 60*b*. By using latching hooks (not shown in the drawing), cap 60*a* engages a recess or opening (not shown in the drawing) formed in protective cover 60. Furthermore, it is acceptable to use a material with adiabatic properties, such as Nylon, for cap 60*a*.

This section describes pipe assembly 20 with reference to FIG. 7, FIG. 7(*a*) is a perspective view, and FIG. 7(*b*) is a cross-sectional view of the encircled part in FIG. 7(*a*), with both FIGS. 7(*a*) and (*b*) showing the condition in which the gas pipe of the nozzle is inserted into pipe assembly 20. Pipe assembly 20 has a tip tube 20*a* made of metal and a tip pipe 20*b* on which tip tube 20*a* is installed. Tip tube 20*a* is of cylindrical shape and has a flame port 82 for emitting a flame from the tip. Tip pipe 20*b* is made from a synthetic resin, for example, and it has a plate-shaped extension 86 integrally formed with cylinder 84 onto which is installed leading-edge tube 20*a*. The tip of extension 8, specifically the end facing the body, is formed in a T-shape. Specifically, a cylindrical protrusion 88 projects in opposing directions perpendicular to the lengthwise direction of pipe assembly 20 and to channels at both sides. As shown in FIG. 7(*b*), a nozzle holder 90 is inserted into a cylindrical sleeve 84 in tip pipe 20*b* and is stored in tip tube 20*a*. At tip tube 20*a*, which accommodates cylindrical sleeve 84 and nozzle holder 90, a space 92 is formed in the lengthwise direction of tip tube 20*a*. In this space 92 is a nozzle (flame-emitting nozzle) 94 and a gas pipe 96 linked to nozzle 94.

Nozzle 94 has a nozzle tip 94*a* and a nozzle body 94*b* into the tip of which is inserted nozzle tip 94*a*. Nozzle 94 is fixed to the leading edge of nozzle holder 90 so that nozzle tip 94*a* is at the outer side of nozzle holder 90. Gas pipe (flexible fuel conduit) 96 is linked by linking pipe 98 to nozzle body 94*b* of nozzle 94. Nozzle cover 100 is installed at the outer-side leading edge of nozzle holder 90 to protect nozzle tip 94*a*.

This section describes in further detail lighter 1 with reference to FIGS. 8 and 9. FIG. 8 is a cross-sectional view along line 8-8 of lighter 1, as shown in FIG. 1. FIG. 9 is a cross-sectional view along line 9-9 of lighter 1, as shown in FIG. 1. As shown in FIG. 8, swing-arm 4 overlaps lighter body 2 in the closed condition, specifically, in the folded condition. Located within lighter body 2 is a piezoelectric unit 102, a housing 104 that holds the piezoelectric unit 102, and a fuel tank 106. Piezoelectric unit 102 has a sliding component 102*a* that is pressed so that the piezoelectric unit 102 generates electricity. Fuel tank 106 is a cylindrical body of a square cross-section that is installed and fixed in housing 104 on the opposite side of piezoelectric unit 102. Piezoelectric unit 102 and fuel tank 106 are positioned and retained by previously described ribs 56*a*, 56*b*, and 56*c*, as well as support sections 38 and 39. In addition, operating button 8 of lighter body 2 is axially supported for free swinging by axle socket 50 so as to face opening 32 of lighter body 2.

This section describes operating button 8 with reference to FIG. 10. FIG. 10 shows operating button 8, FIG. 10(*a*) is a perspective view, FIG. 10(*b*) is a top view, FIG. 10(*c*) is a side view, and FIG. 10(*d*) is a front view. Operating button 8 has an upper wall 108 that in the top view is of a transforming shape from circular to elliptical by forming a large arching shape on one side and a small arching shape on the other side. A peripheral wall 110 encompasses the circumference of upper wall 108, and the inner side of peripheral wall 110 becomes a cavity. Within peripheral wall 110, a plate 8*a* projects in the lateral direction, and one side of plate 8*a*, specifically toward the half-lighter body 2*b* side, an L-shaped engagement hook (hook component) 8*b* extends with upward inclination. At the leading edge of engagement hook 8*b*, a protrusion 112 is formed facing inward.

Plate 8*a* contacts the lower edge of one side of opening 32 of lighter body 2, with operating button 8 located under the opening. In this way, operating button 8 does not project beyond opening 32. In addition, at the other side of peripheral wall 110, a pair of cylindrical shafts 8*c* used for axle support from axle socket 50 projects to a position corresponding to axle socket 50. The lower edge of peripheral wall 110 has a cutout 8*d* that faces downward. Moreover, as shown in FIG. 8, an arm 8*e* is integrally fixed downward from the other side of upper wall 108. At the lower side of this arm 8*e*, a curved protrusion 116 is formed to face sliding component 102*a*.

When operating button 8 is axially supported by axle socket 50, the previously described engagement hook 8*b* is positioned at swing-mount 6. In addition, curved protrusion 116 of arm 8*e* is positioned to contact sliding component 102*a*, or the vicinity thereof, with sliding component 102*a* in a condition being projected by outward biasing of a spring. Moreover, shaft 8*c* is axially supported in elliptically shaped axle socket 50, and shaft 8*c* enables horizontal movement to the opposite side. At swing-mount 6, circular axle sockets 30*a* and 30*b* of half-bodies 2*a* and 2*b* are inserted for free swinging within arching inner wall 70 of swing-arm 4.

FIGS. 8 and 9 clearly show swing-arm 4 to be axially supported by lighter body 2. Specifically, arching inner wall 70 of swing-arm 4 is axially supported for free swinging by axle sockets 30*a* and 30*b* of half-bodies 2*a* and 2*b*. FIG. 8 shows axle socket 30*b*, and FIG. 9 shows axle socket 30*a*. In addition, sleeve 146 is inserted and fixed at the inner side of unified axle sockets 30*a* and 30*b*. Sleeve 146 has a cylindrical shape and annular projections 147 at both sides (FIGS. 1 and 2). Additionally, an annular step 148 is formed at the outer peripheral edge of respective openings 24*a* and 24*b* of half-bodies 2*a* and 2*b*, as shown in FIG. 3(*a*) and FIG. 13. When sleeve 146 is inserted into axle sockets 30*a* and 30*b*, annular projections 147 of sleeve 146 are engaged with annular step 148, and along with the fixing of sleeve 146 within axle sockets 30*a* and 30*b*, it supports half-bodies 2*a* and 2*b* in a manner that half-bodies 2*a* and 2*b* will not be separated.

This section describes the positional relationship between engagement hook 8*b* within swing-mount 6 and protrusion 74 of swing-arm 4. FIG. 12 is a partial cross-sectional perspective showing swing-mount 6 and the related vicinity when swing-arm 4 is in the closed condition. Engagement hook 8*b* is positioned in the edge vicinity of annular wall 26*c*, and protrusion 112 of engagement hook 8*b* is positioned in the edge vicinity of the inner side of annular wall 26*c* of swing-arm 4. Therefore, protrusion 74 formed below the edge of annular wall 26*c* is spaced downward from engagement hook 8*b*.

As shown in FIGS. 8 and 9, previously described pipe assembly 20 is located within protective cover 60 of swing-arm 4, and extension 86 is positioned at swing-mount 6 after passage through opening 66 of swing-arm 4. Therefore, protrusion 88 of extension 86 is positioned at one end of stoppers 40*a* and 40*b*, and is engaged with stoppers 40*a* and 40*b*, specifically, engagement member 40. If at this time an attempt is made to pull tip tube 20*a* outward, it cannot be done because protrusion 88 is engaged with engagement member 40, and therefore tip tube 20*a* maintains a compact condition. Moreover, only stopper 40*b* is visible in FIG. 8, and stopper 40*a* is positioned identically at the forward side. At this time, protrusion 88 is positioned between stoppers 40*a* and 40*b*. In this condition, pipe assembly 20 does not protrude to the outside from protective cover 60 at the opposite end but is withdrawn into protective cover 60.

This section further describes lighter 1 with reference to FIG. 9. At housing 104, in which fuel tank 106 is installed, has a connector 118 connected to gas pipe 96 for supplying fuel to gas pipe 96. Gas pipe 96 passes through swing-mount 6 and reaches pipe assembly 20. Lever (swing preventer) 120 is located in a position corresponding to a notch 8*d* of operating button 8. The aforementioned lever 120 comprises a safety mechanism that prevents the folding of swing-arm 4. The following describes lever 120 with reference to FIGS. 11 and 13. FIG. 11(*a*) is a perspective view, FIG. 11(*b*) is a top view, FIG. 11(*c*) is a right-side view, FIG. 11(*d*) is a front view, and FIG. 11(*e*) is a bottom view. In addition, FIG. 13 is a partial cross-sectional perspective showing swing-mount 6 and the related vicinity.

Lever 120 has a substantially flat and elongated shape, and a cylindrical spindle 120*a* projects in the sideways direction at a side edge 124*a* in the vicinity of one end. As shown in FIG. 11(*a*), the section extending toward the side of operating button 8 from spindle 120*a* is referred to as a first arm 121, and the section extending toward swing-mount 6 is referred to as a second arm 123. In addition, at upper surface 126 and lower surface 128 of lever 120, a curved protrusion 120*c* is formed, having a position aligned with spindle 120*a*. Moreover, at second arm 123, a rectangular flange 120*b* projects toward the side opposite of spindle 120*a* and toward the lower surface 128 of side edge 124*b*. On first arm 121 is formed a rectangular plate 120*d*, which is larger than rectangular flange 120*b*. Lever 120 is axially supported by spindle 120*a* in an axle socket 122 (FIG. 3(*b*)) having rectangular plate 120*d* at the side of operating button 8. Lever 120 is then supported by a compression coil spring (hereafter simply referred to as a spring) 130 located at the side of half-lighter body 2*a*. In the assembled condition of lighter 1, notch 8*d* of operating button 8 engages with rectangular plate 120*d* of first arm 121. Leading edge 120*e* of second arm 123 incorporating rectangular flange 120*b* is engaged with slot 78 of arching inner wall 70 of swing-arm 4.

With reference to FIGS. 14 and 15, this section describes the use of lighter 1 having the above-described structure. FIG. 14 is a vertical cross-section similar to FIG. 6 and shows a partially open swing-arm 4 of lighter 1. FIG. 15 is an enlarged cross section of primary components, specifically showing swing-mount 6, operating button 8, and the related vicinity. With reference to FIG. 15, when swing-arm 4 is turned into the open position, protrusion 88 of pipe assembly 20 separates from engagement member 40 and swings clockwise (in FIG. 14). If a user places a finger or any other external object into the space between operating button 8 and swing-arm 4 and if the swing-arm 4 is inadvertently turned toward the closing direction, operating button 8 shifts downward in the direction shown by arrow 136.

At this time, lever 120 engaged with operating button 8 swings counterclockwise per FIG. 14. As shown in detail in FIG. 15, leading edge 120*e* of lever 120 engages with slot 78 of arching inner wall 70 of swing-arm 4. Then, when pressing operating button 8 downward by further action of swing-arm 4, operating button 8 presses further downward rectangular plate 120*d* of lever 120. The result is that leading edge 120*e* of lever 120 biases upward rib 76 formed with adjacent contact above slot 78. In this way, protective cover 60 of swing-arm 4 is prevented from shifting further downward. At this time, operating button 8 is difficult to press because of resistance on the side of lever 120. In this condition, arm 8*e* of operating button 8 presses the sliding component 102*a* of piezoelectric unit 102 to some extent but does not reach the ignition point.

The following describes the positional relationship between engagement hook 8*b* of operating button 8, located at the opposite side of lever 120, and protrusion 74 formed on annular wall 26*c* of swing-arm 4 with reference to FIG. 16. FIG. 16 is a cross-sectional view similar to FIG. 14 but shows the parts of the lighter 1 in positions similar to FIG. 8. FIG. 16(*a*) is a cross-section of lighter 1 in the condition identical to that of FIG. 14. FIG. 16(*b*) is a cross-sectional view that shows essential parts of the device when operating button 8 is further pressed. As shown in FIG. 16(*a*), protrusion 74 is positioned in the vicinity of engagement hook 8*b*, but is not yet at the point of engagement. By pressing operating button 8, arm 8*e* of operating button 8 slightly presses sliding component 102*a*.

In this condition, when swing-arm 4 is pressed further downward along with swing-arm 4 opening in the counterclockwise direction per FIG. 16(*b*), engagement hook 8*b* of operating button 8 engages with protrusion 74, as previously described. Specifically, protrusion 74 is inserted between protrusion 112 of engaging hook 8*b* and annular wall 26*c*. At this time, arm 8*e* of operating button 8 presses further on sliding component 102*a*, but not to the point of ignition. In order to ignite the lighter, shaft 8*c* of operating button 8 must shift to the right within axle socket 50 per FIG. 8, and sliding component 102*a* must be further pressed by shifting operating button 8. However, protrusion 112 of engaging hook 8*b* does not allow shifting because it is engaged with protrusion 74. In this way, a locking structure is formed by engaging hook 8*b* and protrusion 74. When swing-arm 4 is slightly opened, inadvertent ignition is prevented when a finger or a foreign body 134, which is placed between the swing-arm 4 and the lighter body 2, presses operating button 8 through the intermediary of swing-arm 4.

With reference to FIG. 17, this section describes the condition in which swing-arm 4 opens further. FIG. 17 is a partial cross-section showing swing-arm 4 in the open position at an approximate right angle. In this condition, the previously described bump-like protrusions 73 of protrusion portions 72*a* and 72*b* are respectively engaged with notches 30*d* and 30*e*, the position of swing-arm 4 is maintained in this condition, and protrusion 74 is separated from engaging hook 8*b*. Accordingly, it is possible attempt ignition by pressing operating button 8, but ignition does not generally occur in this position. Even in the event of inadvertent ignition, the flame emitted from flame port 82 of swing-arm 4 will not blow near the hand that holds lighter body 2 and thus cannot cause a burn. The important factor is that with swing-arm 4 in this position, previously described protrusion 88 of pipe assembly 20 contacts stopper 41 of lighter body 2. Accordingly, if swing-arm 4 swings further open in the counterclockwise direction, the pipe assembly 20, located within protective cover 60, will start sliding and will cause pipe assembly 20 to protrude from protective cover 60 because protrusion 88 engages against stopper 41.

With reference to FIGS. 18 and 19, this section describes the condition in which swing-arm 4 is further opened. FIG. 18 is a vertical cross-section of lighter 1 that shows the condition in which swing-arm 4 has been opened approximately 150 degrees, and FIG. 19 is a vertical cross-section of lighter 1 showing a position that differs from that in FIG. 18. As shown in FIGS. 18 and 19, with protrusion 88 of pipe assembly 20 in contact with stopper 41, because swing-arm 4 will be turned, tip tube 20*a*, which becomes the nozzle tip 94*a* edge of pipe assembly 20, protrudes from exposure port 60*b* of protective cover 60 (FIG. 6 (*a*)). In this condition and at the time of ignition, even if tip tube 20*a* contacts an external foreign object, such as gas equipment (not shown in the drawing), because protrusion 88 of pipe assembly 20 contacts stopper 41, tip tube 20*a* will not be forced into protective cover 60. Accordingly, there is little danger that the flame emitted from flame port 82 will be applied to protective cover 60. As shown in FIG. 18, the lower edge of notch 8*d* of operating button 8 contacts protrusion 46*a* of lighter body 2 and prevents swinging beyond this point. In FIG. 19, the shift amount of sliding component 102*a* does not attain the amount required to generate voltage.

When horizontally shifting operating button 8 to the right from the aforementioned condition, as shown by arrow 138 in FIG. 20, the necessary amount of sliding movement for sliding component 102*a* to initiate ignition can be obtained. FIG. 20 is an enlarged cross-sectional view showing the main components in the condition wherein operating button 8 has been caused to slide. As shown in FIG. 20, by sliding operating button 8, arm 8*e* presses sliding component 102*a* of piezoelectric unit 102 for a prescribed distance, and piezoelectric unit 102 generates electricity. This causes an electric discharge in the vicinity of nozzle tip 94*a*. If there is an attempt to close lighter body 2 by swinging swing-arm 4, which is emitting a flame, clockwise in the view shown in FIG. 20, then protrusion 74 of swing-arm 4 will engage with protrusion 112 of engaging hook 8*b* and will generate resistance, thus preventing closing to less than the prescribed angle. Accordingly, it is possible to prevent burns to the hand that holds lighter body 2 or scorching of clothing.

In addition, operation of the fuel supply valve is linked to shifting of sliding component 102*a*. This fuel supply valve operation is shown in FIG. 21. FIG. 21 is a cross-sectional view along line 21-21 of FIG. 8 and shows the operating condition of the fuel supply valve. FIG. 21(*a*) shows the condition prior to ignition, and FIG. 21(*b*) is a partial cross-sectional view that shows the condition after ignition. Sliding component 102*a* is positioned at the side of the fuel supply valve and has a lever depressor 102*b* integrally formed with sliding component 102*a* along the sliding direction of sliding component 102*a*. This lever depressor 102*b* shifts with the shifting of sliding component 102*a*. Additionally, a fuel supply valve 142 is located in housing 104. Engaged with this fuel supply valve 142 is an L-shaped lever 144 axially supported for free oscillation to a shaft 145 within the plane of the drawing. Lever 144 has an engaging arm 144*a* engaged with fuel supply valve 142 and a drive arm 144*b* positioned in the vicinity of lever depressor 102*b*.

When sliding component 102*a* of piezoelectric unit 102 is not pressed to the right, per FIG. 21, drive arm 144*b* protrudes within the pathway of lever depressor 102*b*. When sliding component 102*a* is pressed by arm 8*e* of operating button 8, drive arm 144*b* is pressed by lever depressor 102*b* and moves clockwise per FIG. 21. This swings the engaging arm 144*a* clockwise, shifts the fuel supply valve 142 to the right, and enables gas emission. Gas emitted from fuel supply valve 142 passes through gas pipe 96 and is directed to nozzle 94. In addition, a power line 140 (FIG. 8) is routed from piezoelectric unit 102 to nozzle 94 and the vicinity of nozzle tip 94*a* of tip tube 20*a*, and the power line 140 releases an electric discharge to ignite the gas emitted from nozzle tip 94*a*. These structural components are widely known and therefore a detailed description is omitted.

While the foregoing describes the present invention in relation to illustrations and examples, it is understood that it is not intended to limit the scope of the invention to the illustrations and examples described herein. On the contrary, it is intended to cover all alternative modifications and equivalents that may be included in the spirit and the scope of the invention as defined by the appended claims.

BRIEF DESCRIPTION OF THE DRAWINGS

FIG. 3(*a*) shows the front view as seen from the inner side, and FIG. 3(*b*) is a perspective view as seen from the inner side.

LEGEND

Figure 1:
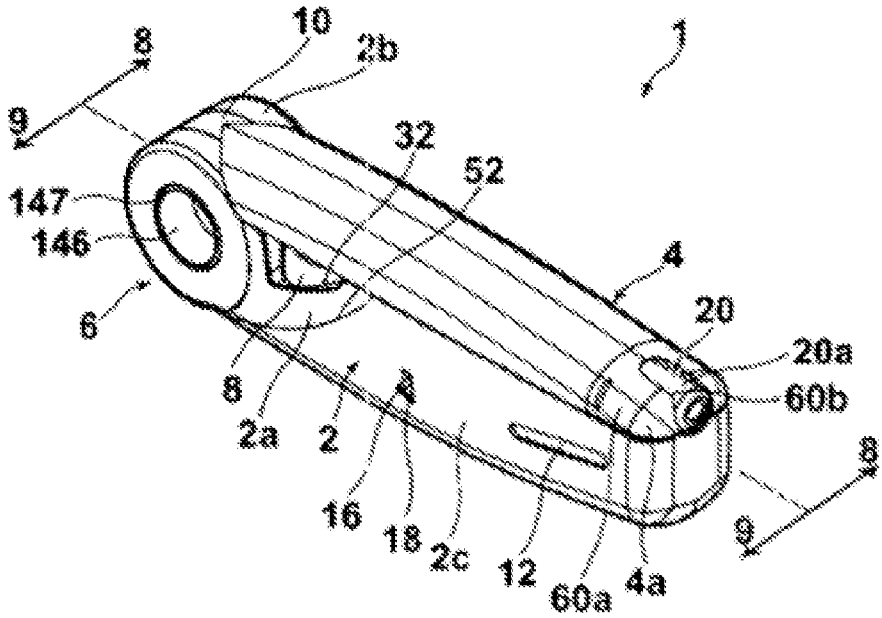
FIG. 1 is a perspective view showing the folded condition of the foldable lighter, being one example of this invention.
Figure 2:
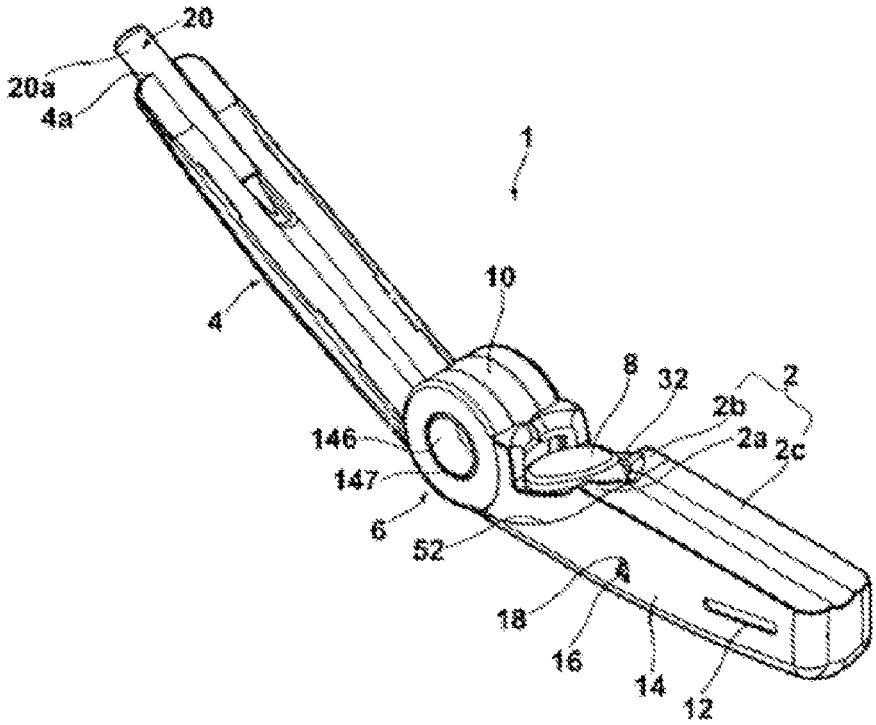
FIG. 2 is a perspective view showing the foldable lighter of FIG. 1 in the open condition and ready for use.
Figure 3:
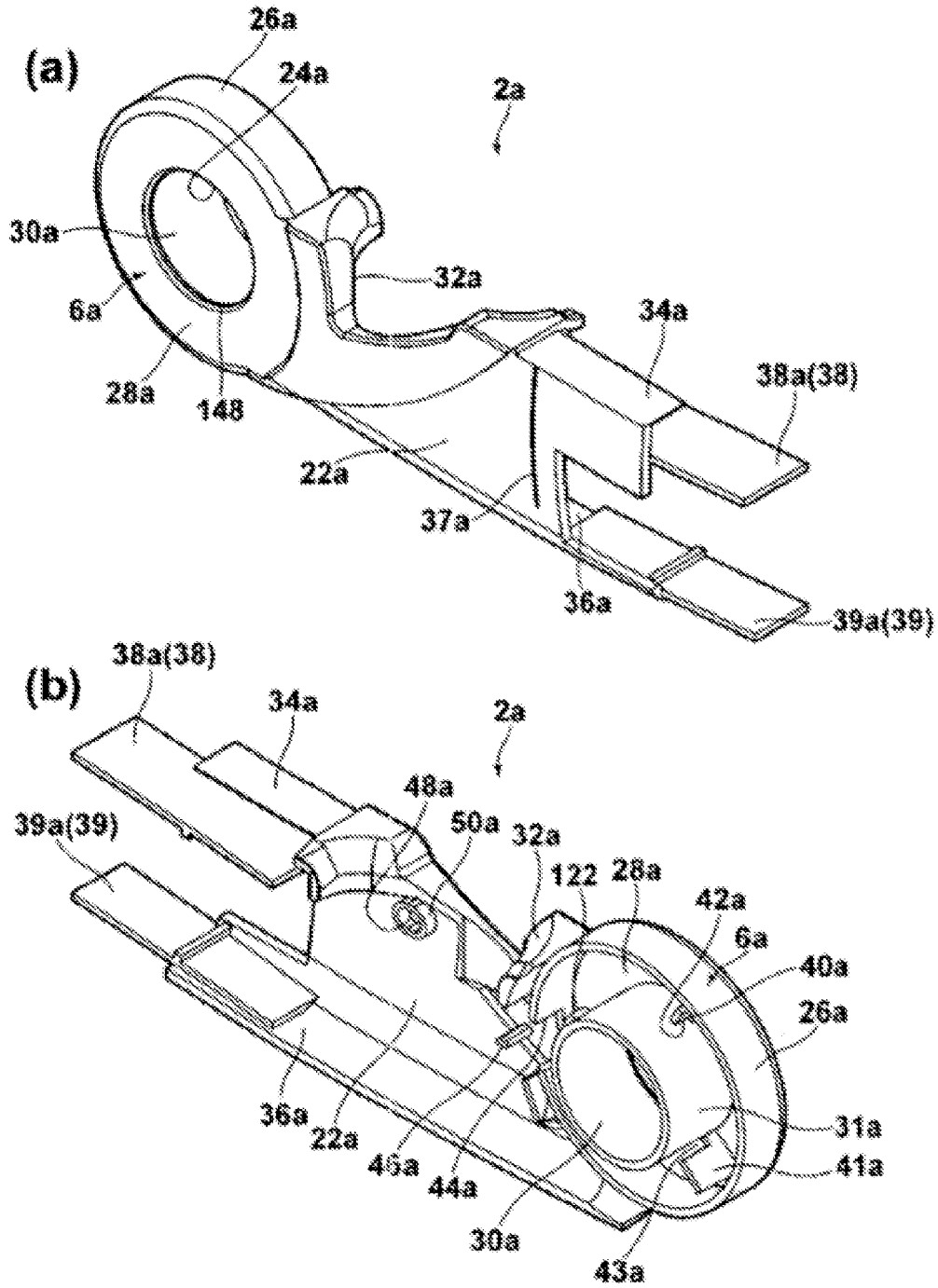
FIG. 3 is a perspective view showing the forward side of the half-body in FIGS. 1 and 2, with FIG. 3(*a*) showing the half-body as seen from the outer side and FIG. 3(*b*) showing the half-body as seen from the inner side.
Figure 4:
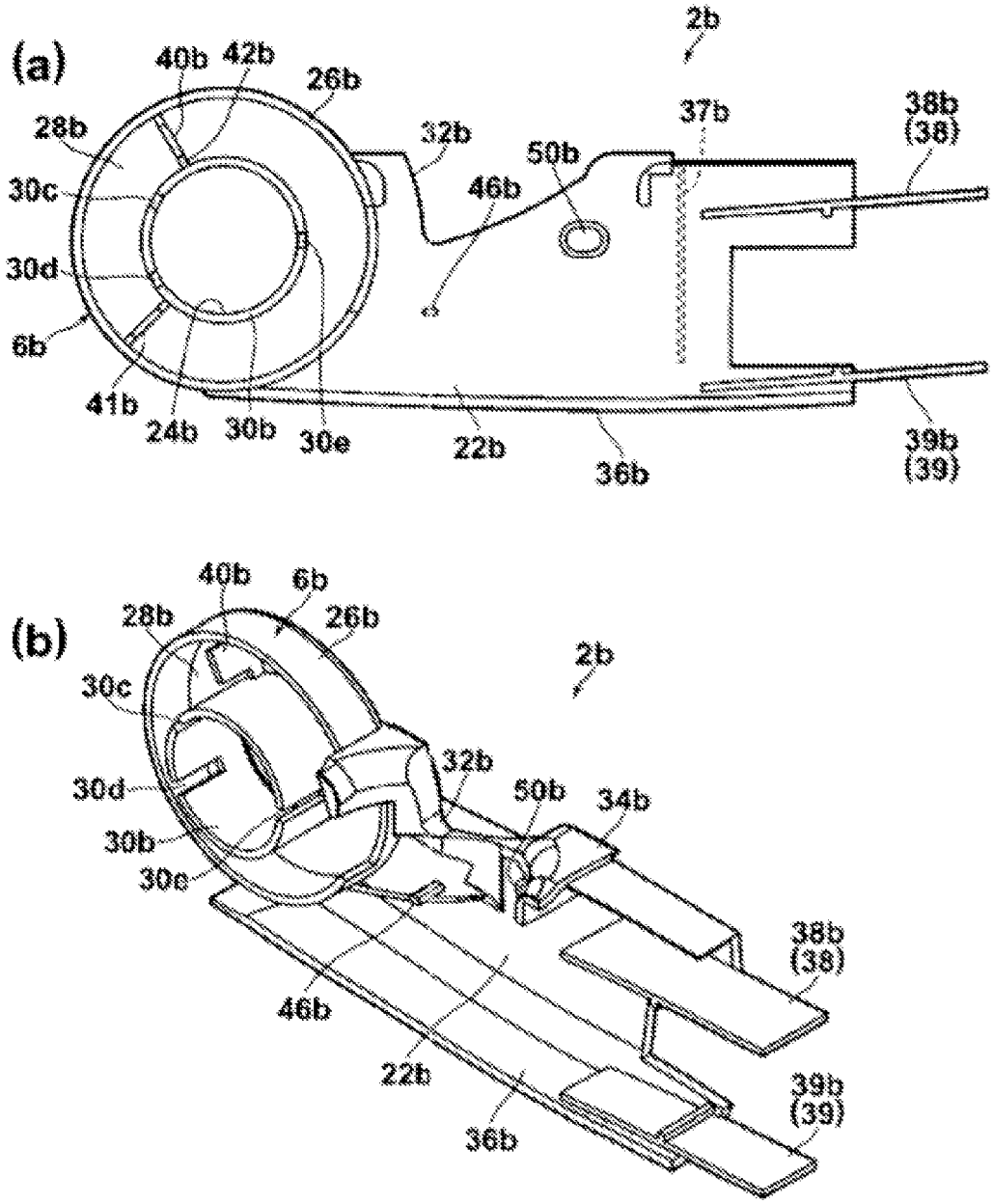
FIG. 4 shows the side of the half-body opposite to that shown in FIG. 3.
Figure 5:
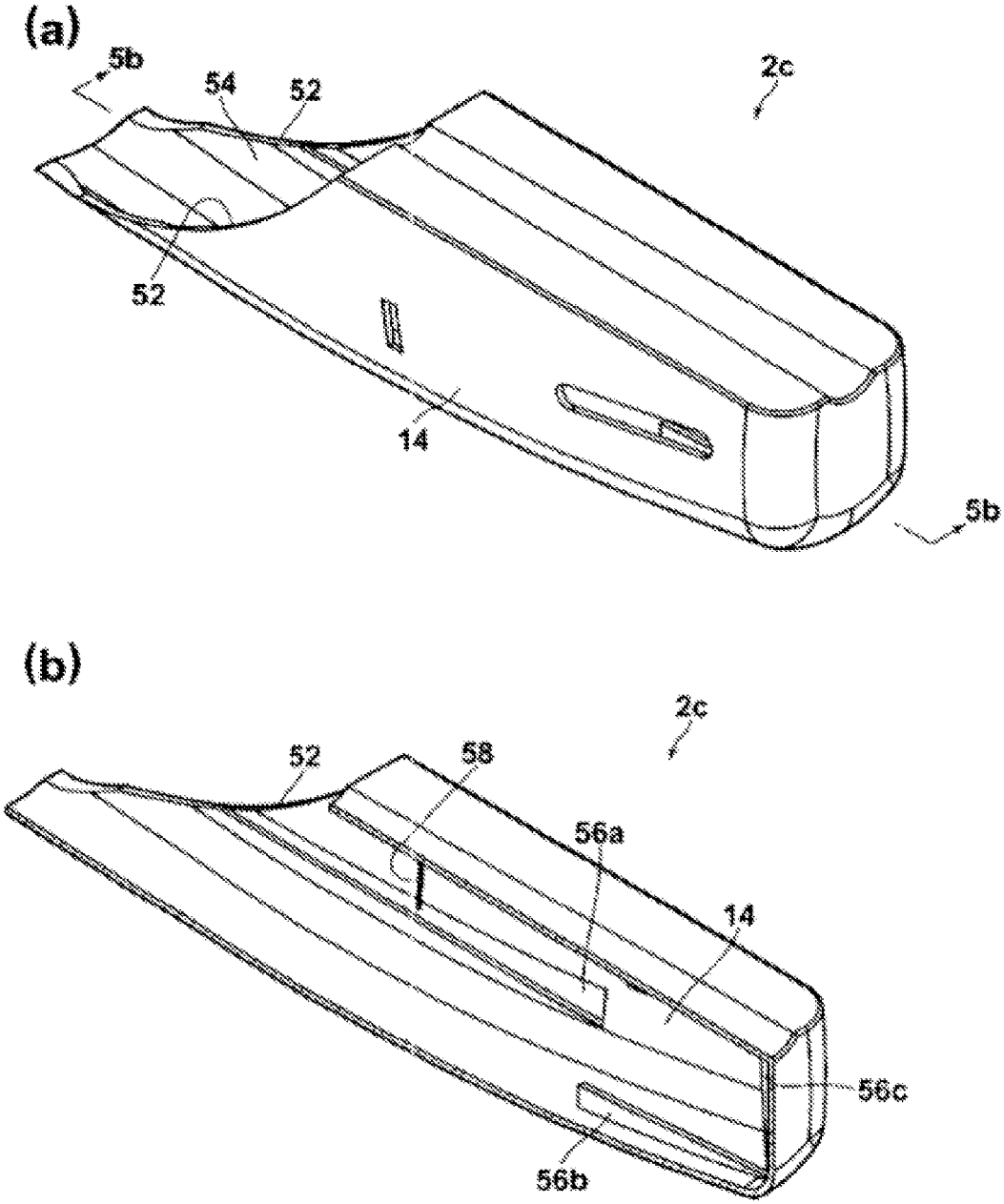
FIG. 5 shows the full-body cover, with FIG. 5(*a*) being a perspective view and FIG. 5(*b*) being a perspective view showing the cross-section along line 5*b*-5*b* of FIG. 5(*a*).
Figure 6:
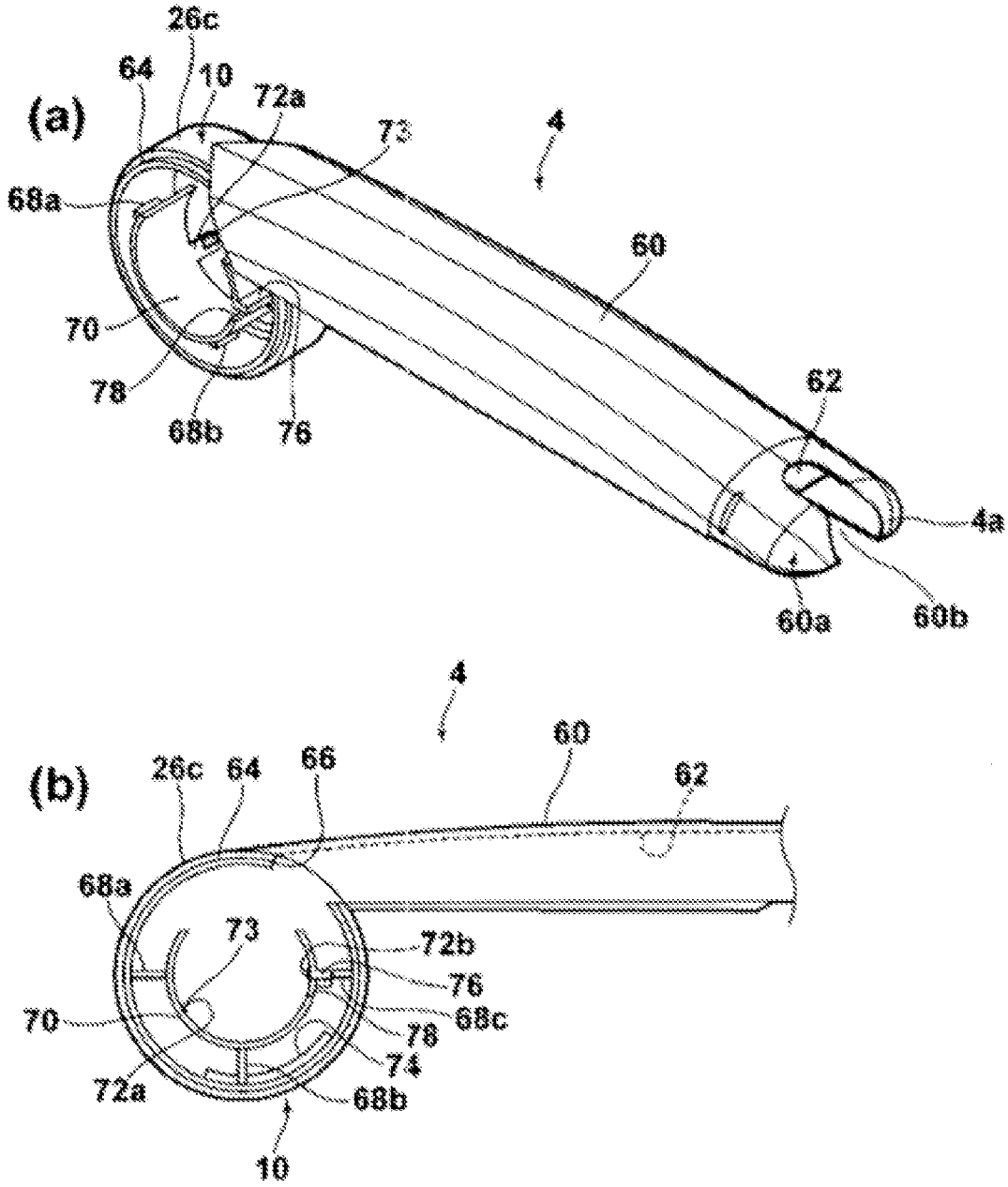
FIG. 6 shows the swing-arm, with FIG. 6(*a*) being a perspective view and FIG. 6(*b*) being a front view.
Figure 7:
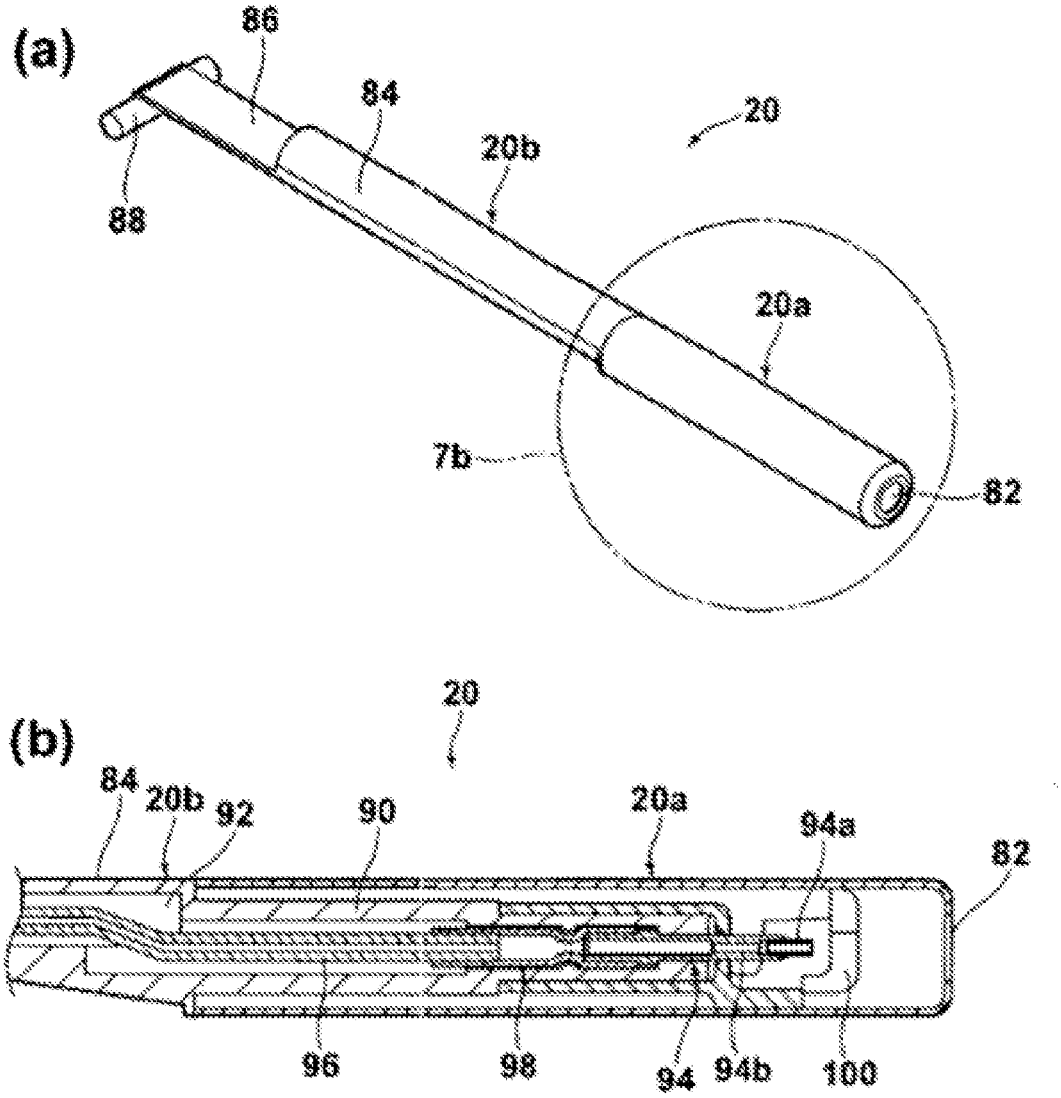
FIG. 7 shows the pipe assembly, with FIG. 7(*a*) being a perspective view and FIG. 7(*b*) being a cross-sectional view of the region shown by circle 7*b* in FIG. 7(*a*) and showing the nozzle and gas pipe within the pipe assembly for the folded condition.
Figure 8:
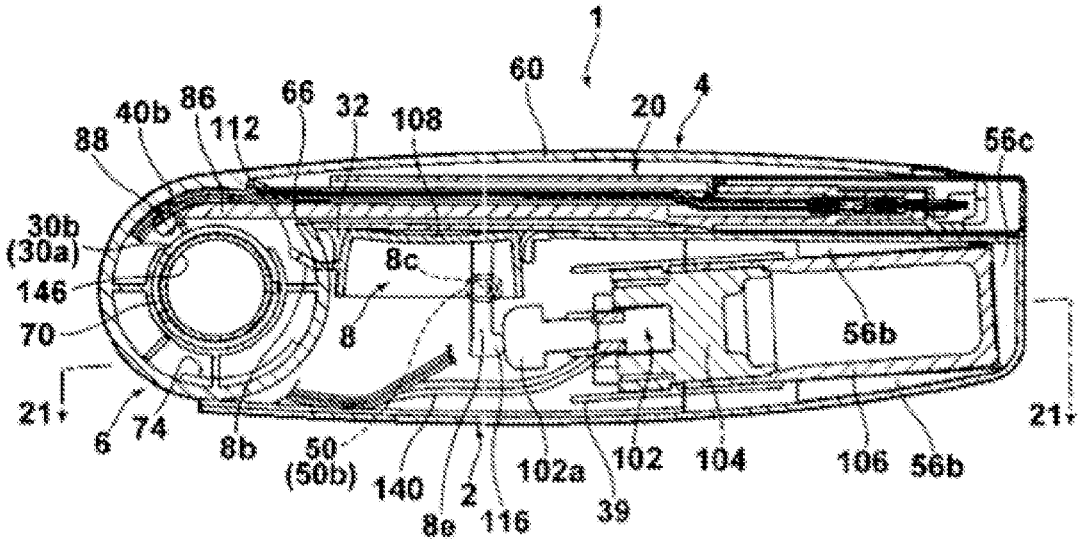
FIG. 8 is a cross-sectional view along line 8-8 of the foldable lighter shown in FIG. 1.
Figure 9:
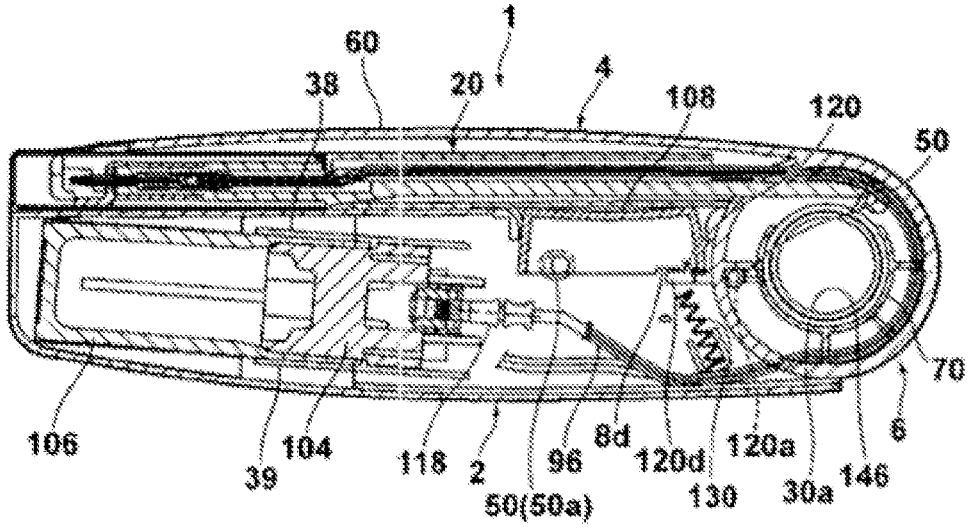
FIG. 9 is a cross-sectional view along line 9-9 of the foldable lighter shown in FIG. 1.
Figure 10:
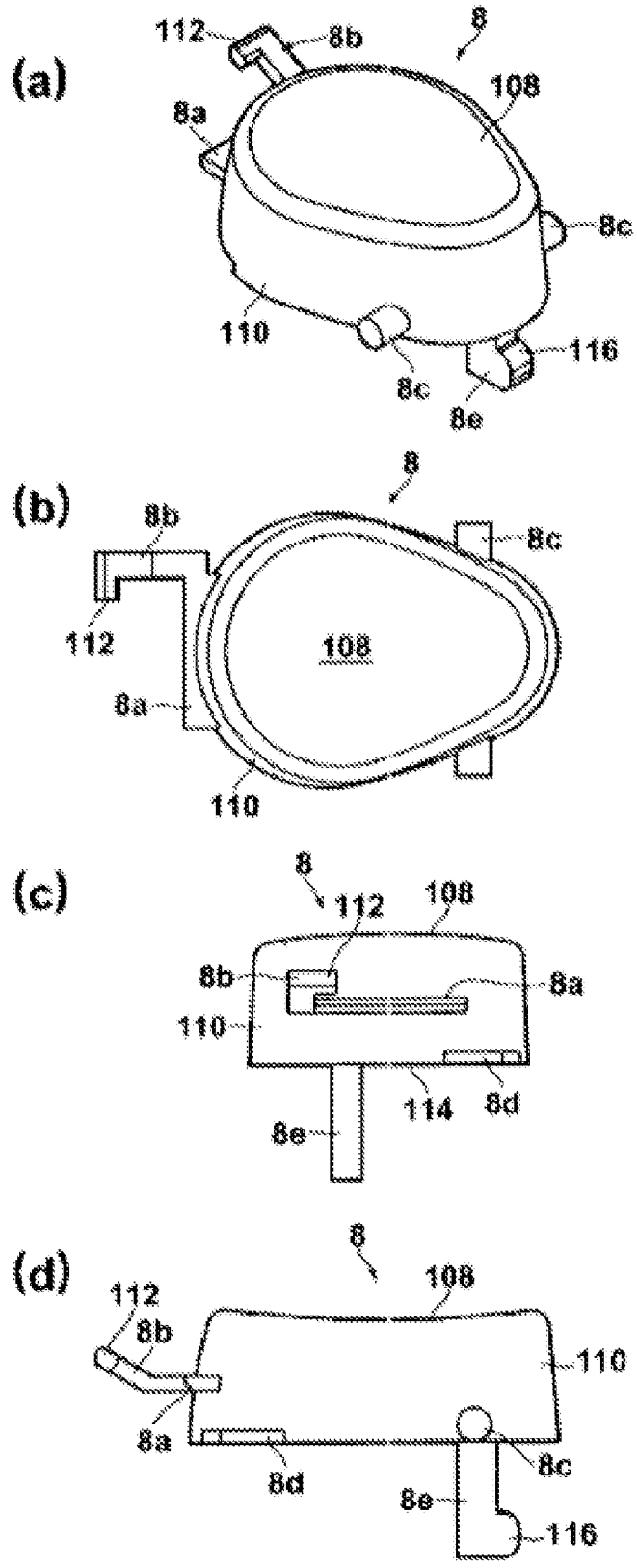
FIG. 10 shows the operating button, with FIG. 10(*a*) being a perspective view, FIG. 10(*b*) being a top view, FIG. 10(*c*) being a side view, and FIG. 10(*d*) being a front view.
Figure 11:
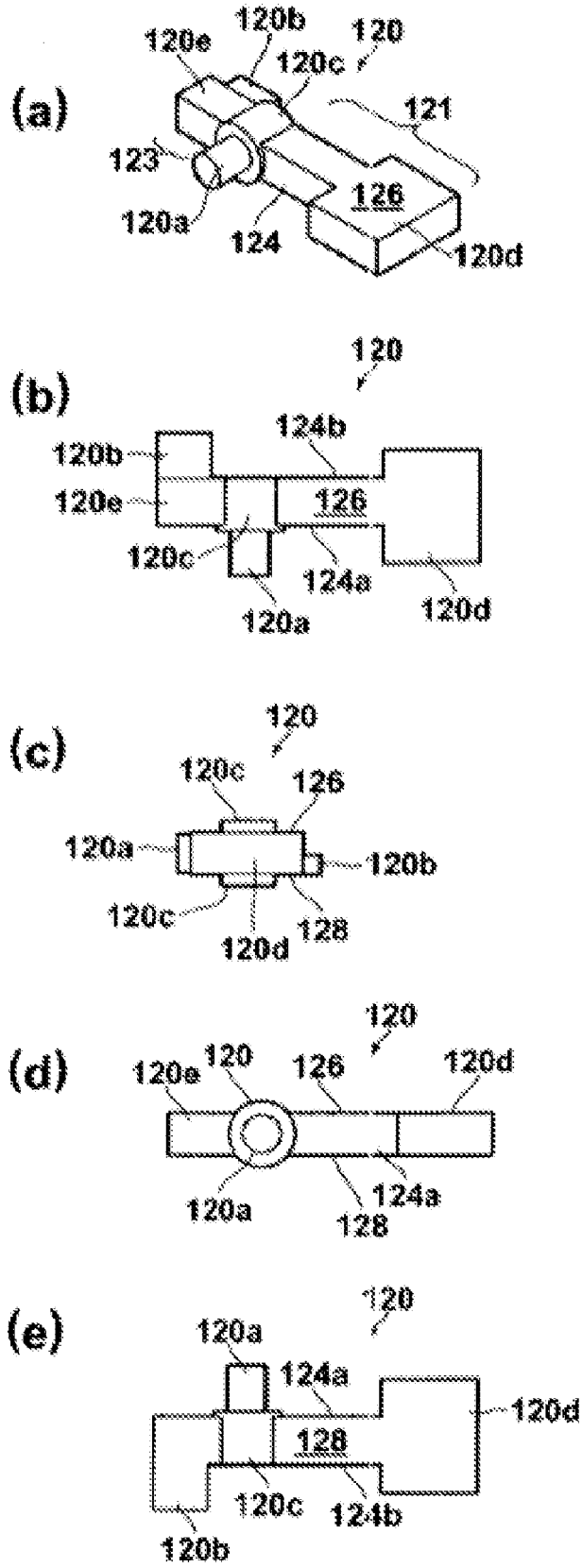
FIG. 11 shows the lever, with FIG. 11(*a*) being a perspective view, FIG. 11(*b*) being a top view, FIG. 11(*c*) being a right-side view, FIG. 11(*d*) being a front view, and FIG. 11(*e*) being a bottom view.
Figure 12:
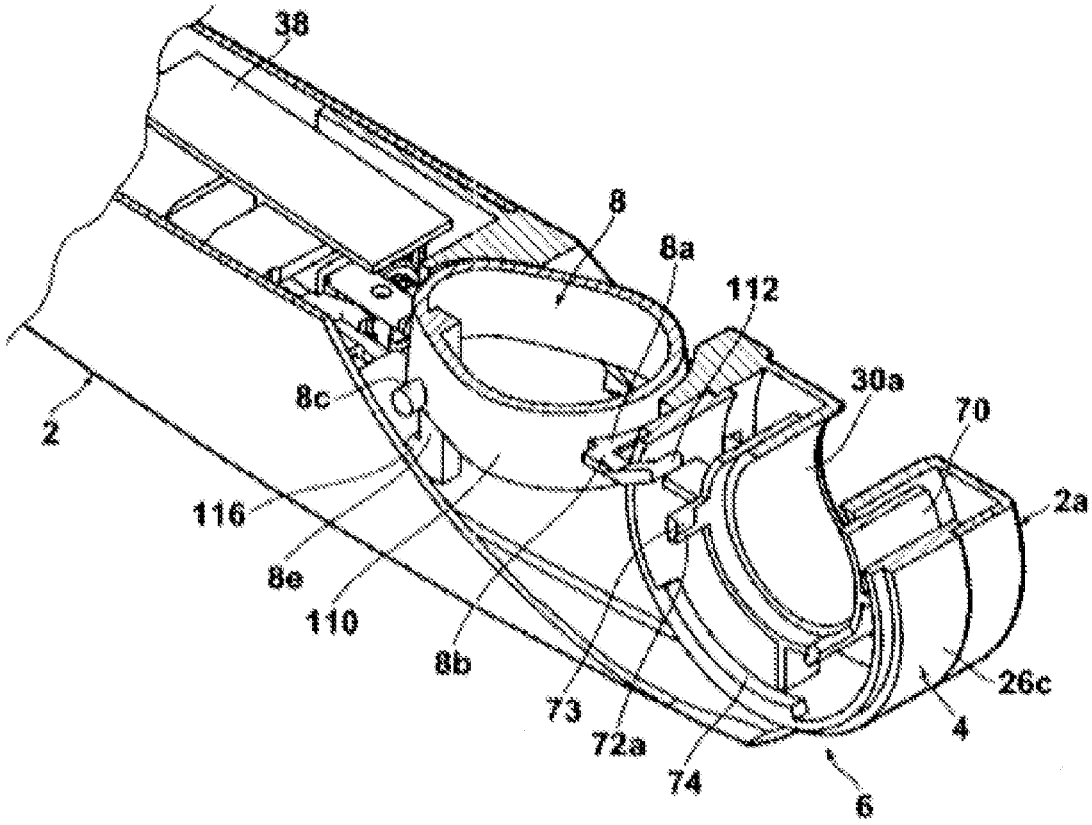
FIG. 12 is a partial cross-sectional perspective view showing the swing-mount and related vicinity when the swing-arm is closed.
Figure 13:
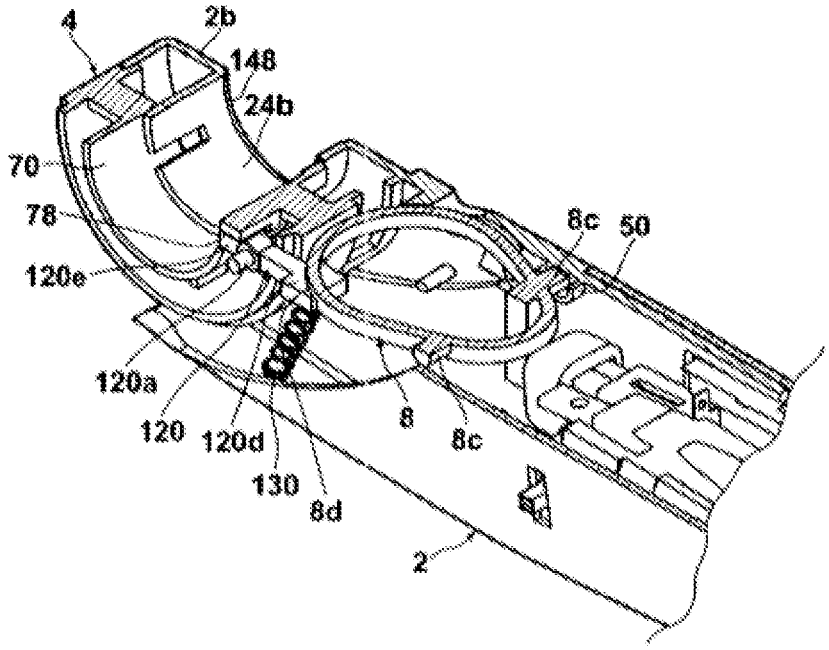
FIG. 13 is a partial cross-sectional perspective view showing the swing-mount and related vicinity.
Figure 14:
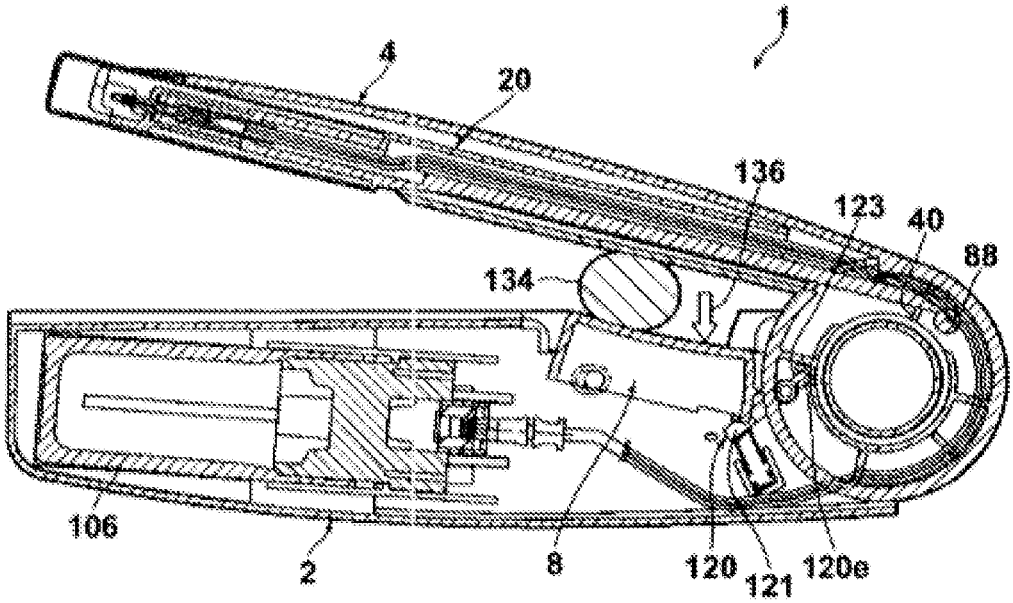
FIG. 14 is a vertical cross-section similar to that in FIG. 6 and showing the condition in which the swing-arm of the foldable lighter is slightly open.
Figure 15:
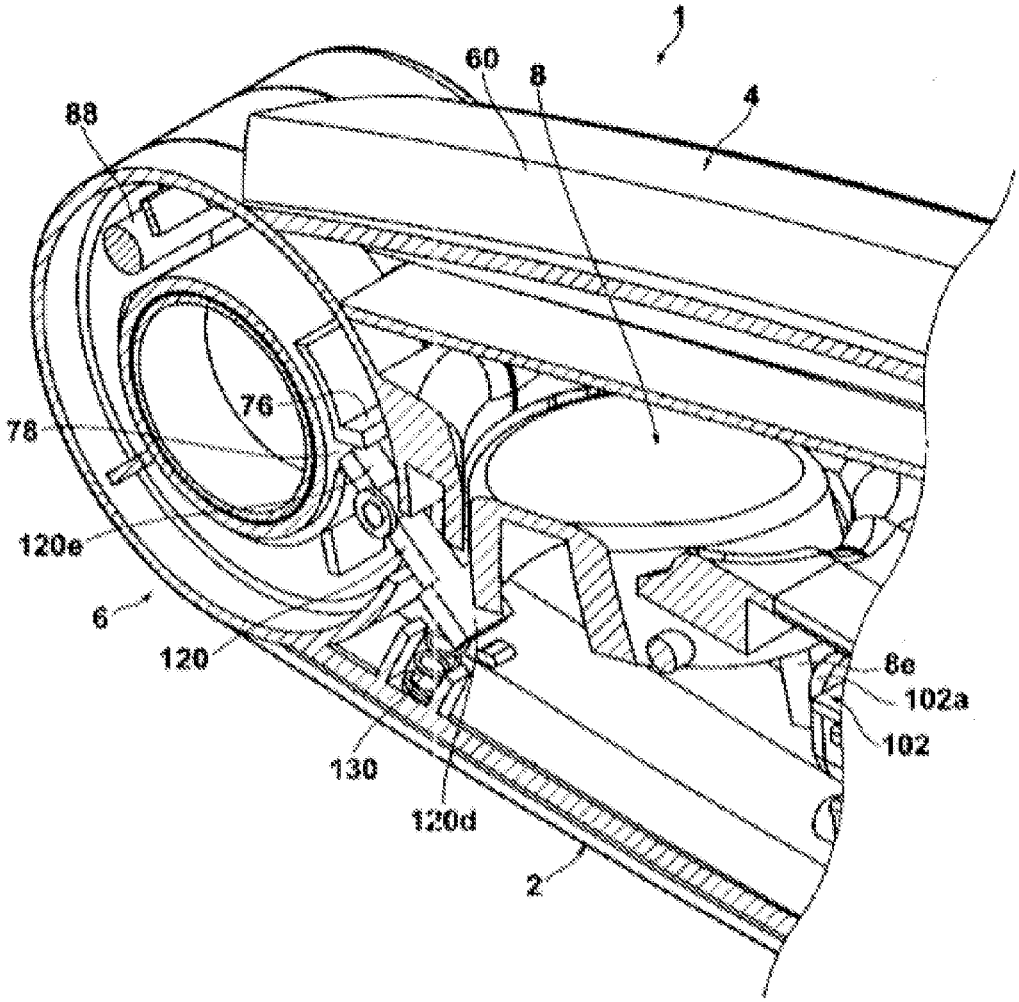
FIG. 15 is an enlarged cross-sectional view showing the swing-mount, operating button, and the related vicinity.
Figure 16:
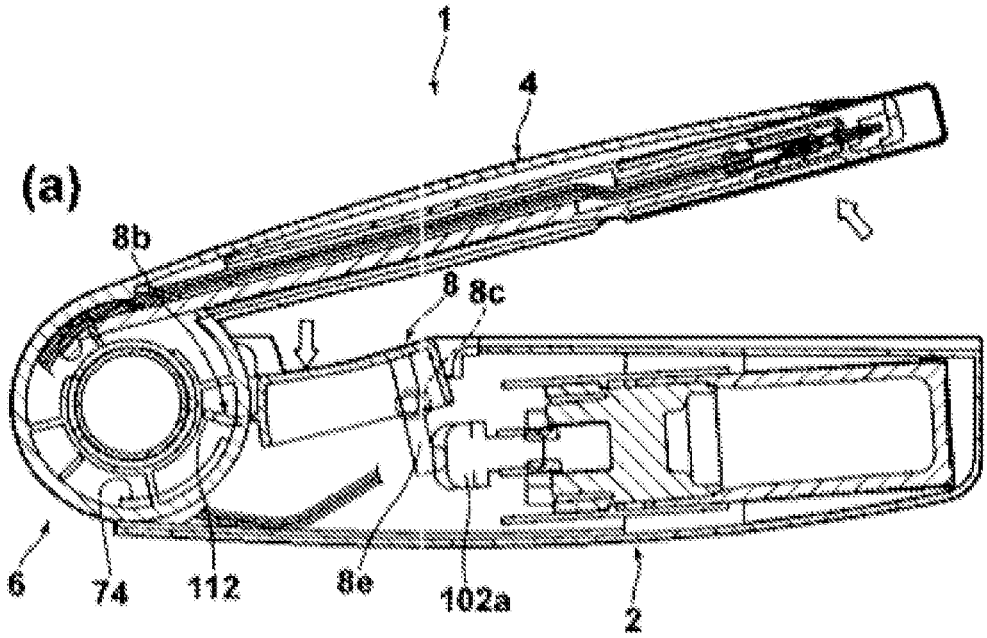
FIG. 16 is a cross-sectional view similar to that in FIG. 8 and showing a cross-section of the foldable lighter for a position different from that of FIG. 14, with FIG. 16(*a*) being a cross-section of the foldable lighter in the condition identical to that of FIG. 14 and FIG. 16(*b*) being a cross-sectional view showing the condition in which the operating button is further pressed.
Figure 16:
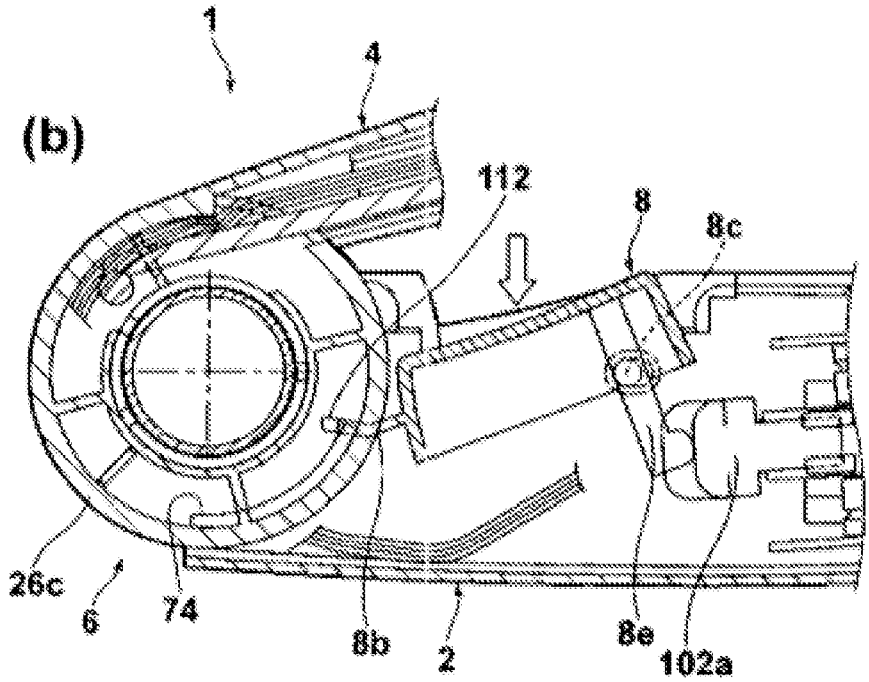
Figure 17:
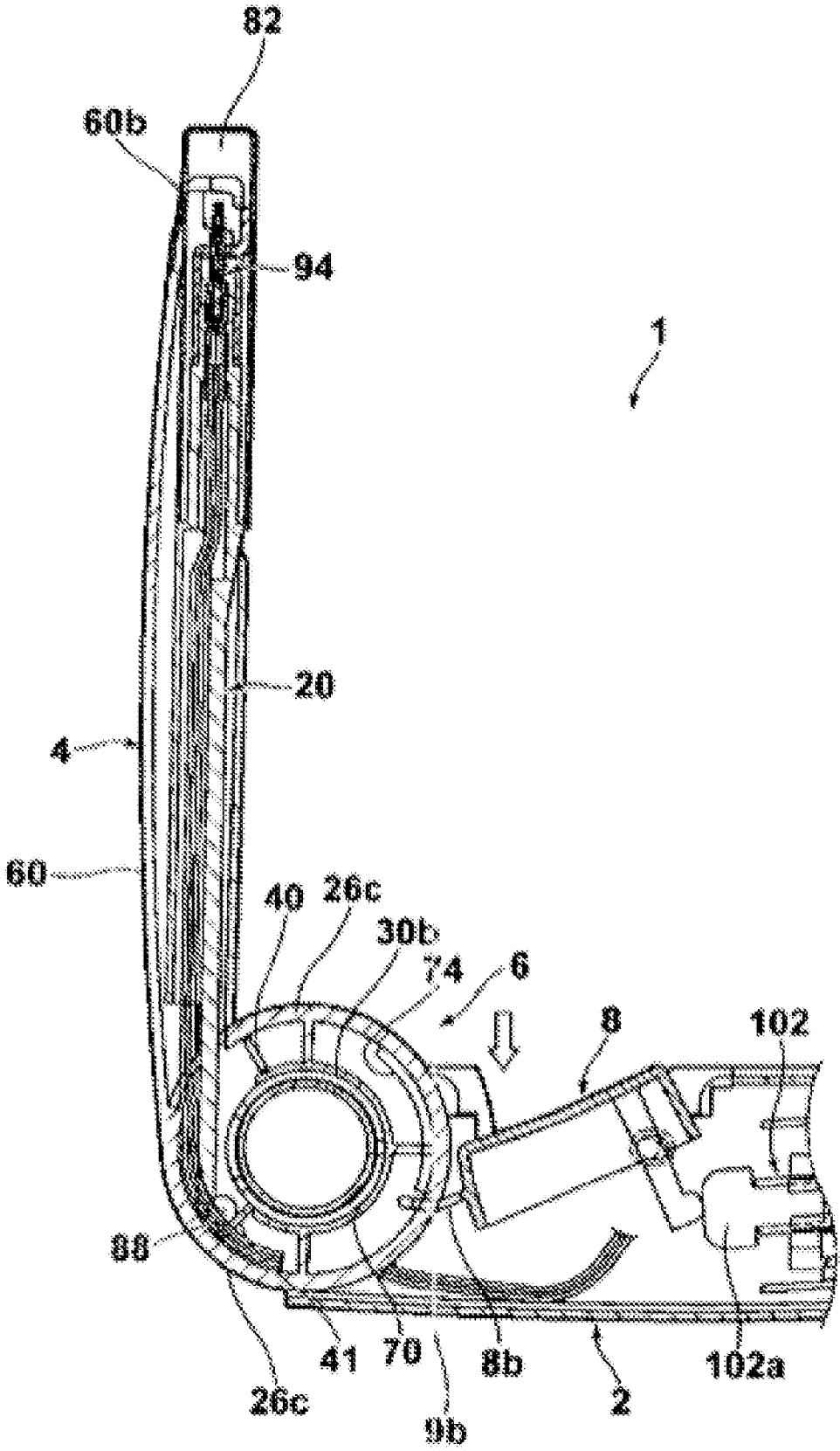
FIG. 17 is a partial cross-sectional view showing the condition in which the swing-arm is open to an approximate right angle.
Figure 18:
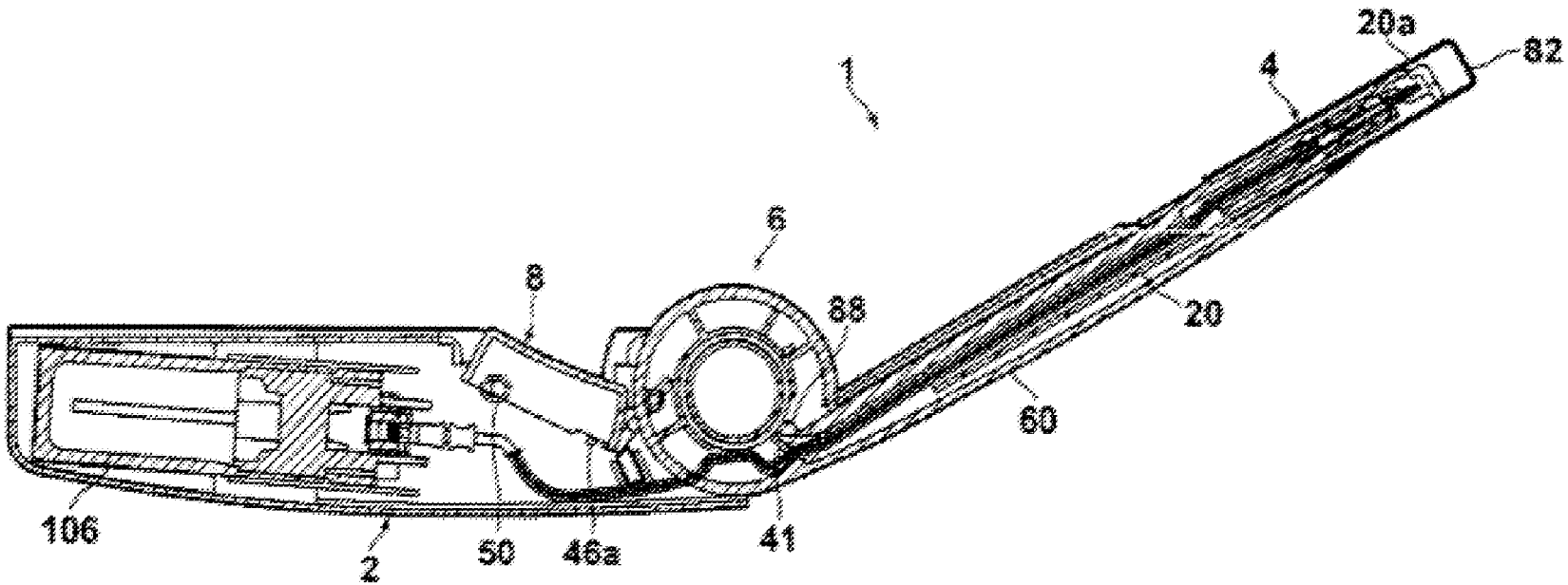
FIG. 18 is a vertical cross-sectional view of the foldable lighter showing the condition in which the swing-arm has been opened to approximately 150 degrees.
Figure 19:
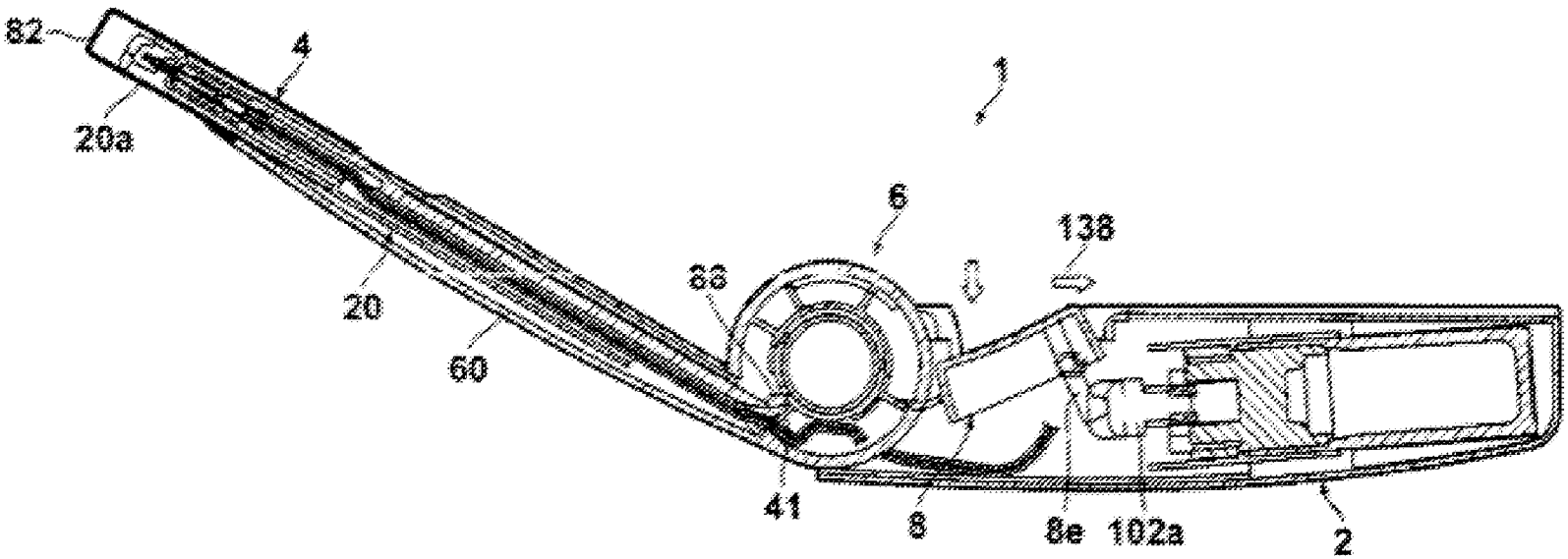
FIG. 19 is a vertical cross-sectional view of the foldable lighter showing a cross-section for a position differing from that of FIG. 18.
Figure 20:
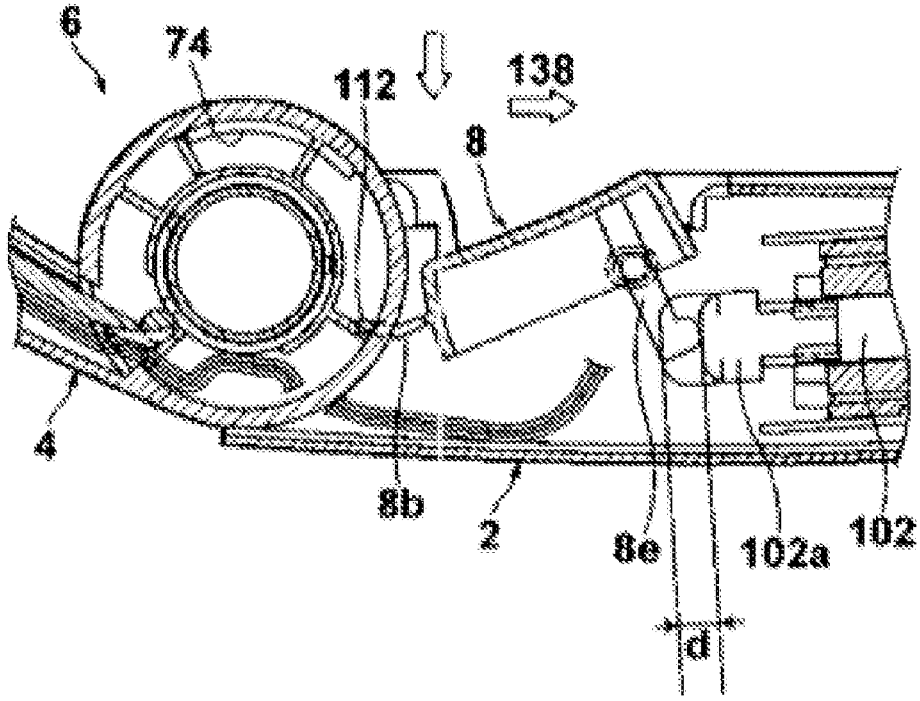
FIG. 20 is an enlarged cross-sectional view showing the condition in which the operating button has been caused to slide.
Figure 21:
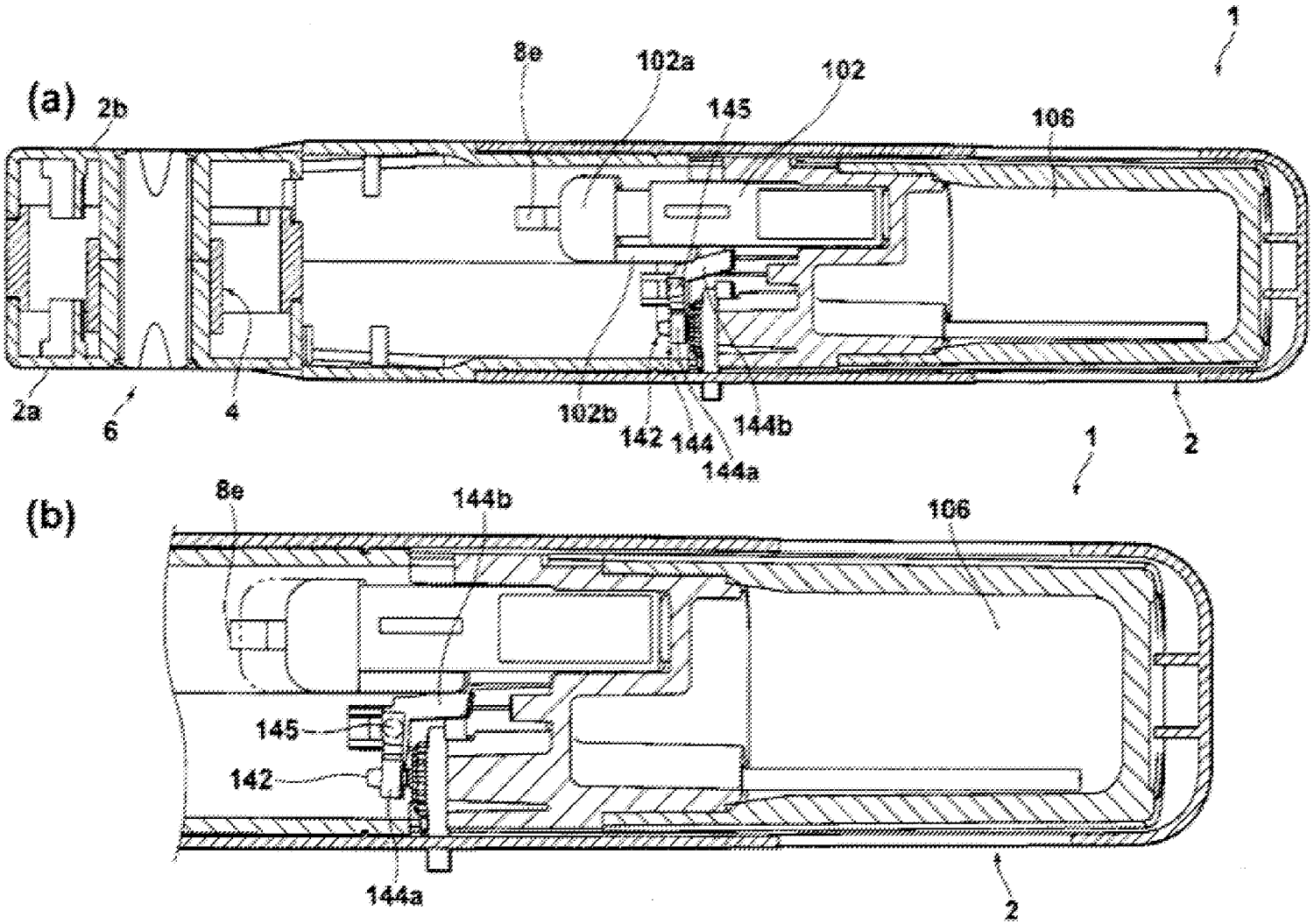
FIG. 21 is a cross-sectional view along line 21-21 of FIG. 8 and showing the operating condition of the fuel supply valve, with FIG. 21(*a*) showing the condition prior to the ignition and FIG. 21(*b*) showing the condition after the ignition.

1 Foldable lighter
2 Lighter Body
4 Swing-arm
8 Operating Button (Operating Component)
20 Pipe Assembly
20*a* Tip tube
26*a*, 26*b*, 26*c* Annular Wall (Cylindrical Wall)
30*a*, 30*b* Axle Socket (Inner Cylinder)
40 Engagement member
41 Stopper
60*b* Exposure Port
70 Arching Inner Wall (Outer Cylinder)
88 Protrusion
94 Nozzle (Flame Emitting Nozzle)
96 Gas Pipe (Flexible Fuel Conduit)
102 Piezoelectric unit
122 Axle Socket
134 Foreign Body
142 Fuel Supply Valve

What is claimed is:

1. A foldable lighter comprising:

a lighter body that contains a fuel tank and a piezoelectric unit and has an operating component exposed to the outside for operating substantially simultaneously the piezoelectric unit and a fuel supply valve that controls supply of fuel from the fuel tank;

a swing-arm that is pivotally connected to one end to the lighter body, has an opening at the other end, and can be pivotally turned relative to the lighter body between a folded position against the lighter body and an operation position in which the swing-arm is opened at 90 degrees or more than 90 degrees relative to the lighter body;

a flame-emission nozzle in the vicinity of the other end of the swing-arm; and a flexible fuel supply tube located in the lighter body and the swing-arm and having one end connected to the fuel tank and the other end to the flame-emission nozzle;

said foldable lighter being characterized by having a cylindrical wall that forms a substantially cylindrical annular space coaxial with the center of rotation of said swing-arm, said cylindrical wall being formed in either the lighter housing or in the swing-arm;

the swing-arm being provided with a pipe assembly that holds a part of a guide tube and the flame-emission nozzle inside the swing-arm and that is capable of sliding in the longitudinal direction of the swing-arm;

in the folded position, the end of the pipe assembly on the side of the lighter body reaching the annular space;

said annular space of the lighter body having: a stopper acting so that during rotation of the swing-arm from the folded position to the operation position, the stopper comes into contact with the pipe assembly end on the lighter-body side and moves the pipe assembly forward under the effect of the aforementioned rotation whereby the end of the pipe assembly on the side of the flame-emission nozzle protrudes from the opening; and an engagement member that engages the end of the pipe assembly on the lighter-body side during rotation of the swing-arm from the operational position to the folded position and withdraws the pipe assembly under the effect of the rotation so that the end of the pipe assembly on the side of the flame-emission nozzle is withdrawn from the aforementioned opening into the swing-arm.

2. The foldable lighter of claim 1, wherein the lighter body contains an axle portion, and the swing-arm has an outer cylindrical sleeve that is slidingly fitted onto the axle portion with possibility of free rotation, the swing-arm further comprising a cylindrical wall that is made integrally with the cylindrical sleeve and forms an annular space.

3. The foldable lighter according to claim 1, wherein the end of the pipe assembly on the lighter-body side has a T-shaped configuration, and the transversely arranged portion of the T-shaped end capable of interacting with an engagement member.

4. The foldable lighter according to claim 2, wherein the end of the pipe assembly on the lighter-body side has a T-shaped configuration, and the transversely arranged portion of the T-shaped end capable of interacting with an engagement member.

* * * * *